US009944090B2

(12) United States Patent
Nishida

(10) Patent No.: US 9,944,090 B2
(45) Date of Patent: Apr. 17, 2018

(54) PRINTING APPARATUS, CONTROL METHOD THEREFOR, AND NON-TRANSITORY COMPUTER-READABLE STORAGE MEDIUM

(71) Applicant: CANON KABUSHIKI KAISHA, Tokyo (JP)

(72) Inventor: Tomofumi Nishida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/247,760

(22) Filed: Aug. 25, 2016

(65) Prior Publication Data

US 2017/0066260 A1 Mar. 9, 2017

(30) Foreign Application Priority Data

Sep. 9, 2015 (JP) ..... 2015-177921

(51) Int. Cl.

| | |
|---|---|
| ***B41J 29/38*** | (2006.01) |
| ***B41J 3/60*** | (2006.01) |
| ***B41J 13/00*** | (2006.01) |
| ***B65H 5/24*** | (2006.01) |

(52) U.S. Cl.

CPC ..... *B41J 3/60* (2013.01); *B41J 13/0018* (2013.01); *B65H 5/24* (2013.01)

(58) Field of Classification Search

None

See application file for complete search history.

(56) References Cited

U.S. PATENT DOCUMENTS 5,954,436 A * 9/1999 Kageyama ..... B41J 3/60 358/1.12
2006/0072138 A1* 4/2006 Nakanishi ..... B41J 3/60 358/1.12
2010/0014884 A1 1/2010 Roppongi
2010/0302298 A1* 12/2010 Moriyama ..... B41J 3/60 347/16
2012/0249655 A1* 10/2012 Yoshida ..... B41J 3/60 347/19
2015/0274477 A1* 10/2015 Kodama ..... B65H 5/36 271/3.19
2016/0052308 A1 2/2016 Sahara et al.

FOREIGN PATENT DOCUMENTS

JP 2000-15881 A 1/2000

OTHER PUBLICATIONS

U.S. Appl. No. 15/247,764, filed Aug. 25, 2016. Inventor: Tomofumi Nishida.
Search Report dated Jul. 19, 2017, in European Patent Application No. 16001822.2.

* cited by examiner

*Primary Examiner* — Matthew Luu
*Assistant Examiner* — Tracey McMillion
(74) *Attorney, Agent, or Firm* — Fitzpatrick, Cella, Harper & Scinto

(57) ABSTRACT

A printing apparatus includes: a feeding unit feeding a sheet; a conveying unit conveying the sheet fed by the feeding unit; a printing unit printing the sheet conveyed by the conveying unit; an inversion path inverting the sheet printed on a first surface by the printing unit and conveying the sheet to the conveying unit; and a conveyance control unit performing conveyance control of overlapping a trailing edge of a preceding sheet conveyed through the inversion path and a leading edge of a succeeding sheet fed following the preceding sheet.

30 Claims, 14 Drawing Sheets

FIG. 5
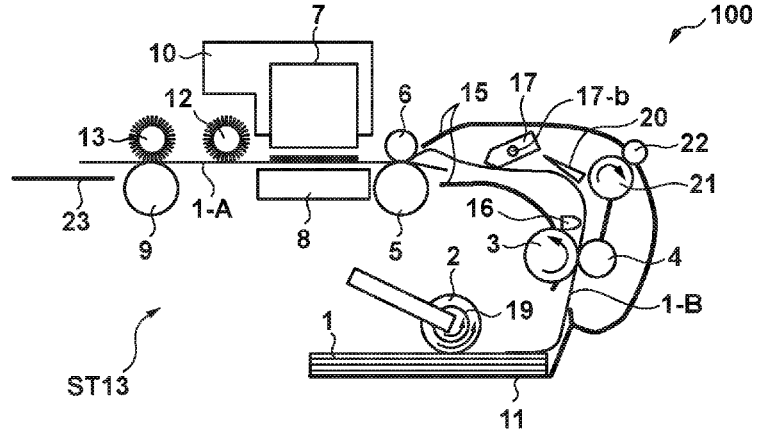
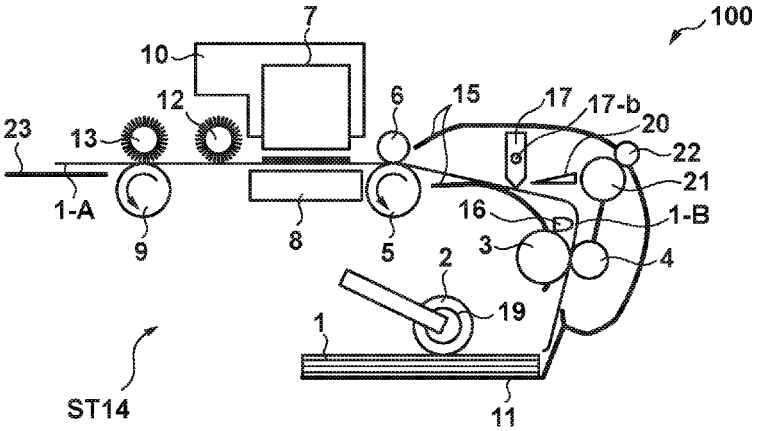

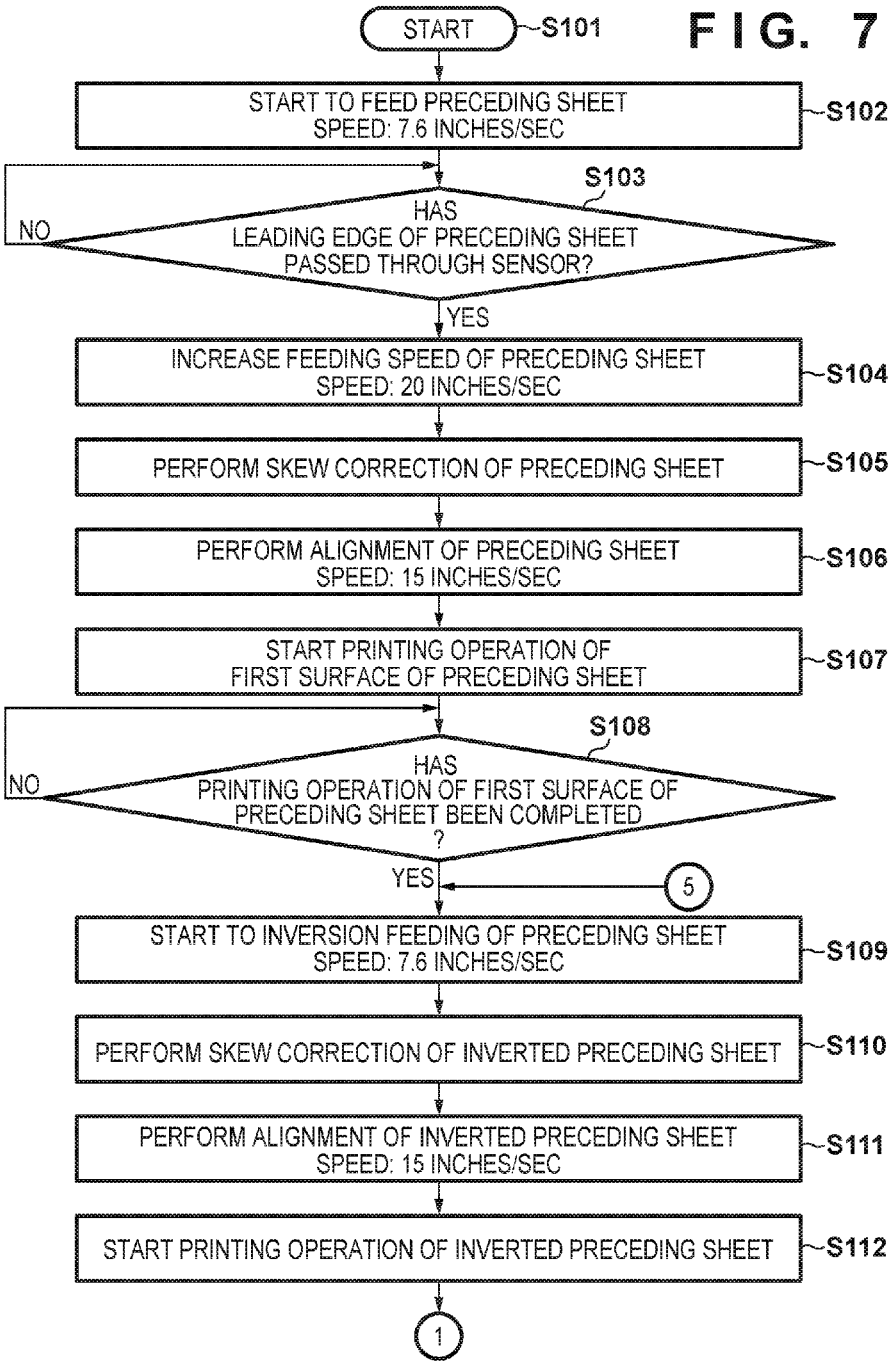
FIG. 7
START
S101
START TO FEED PRECEDING SHEET
SPEED: 7.6 INCHES/SEC
S102
S103
HAS
LEADING EDGE OF PRECEDING SHEET
PASSED THROUGH SENSOR?
NO
YES
INCREASE FEEDING SPEED OF PRECEDING SHEET
SPEED: 20 INCHES/SEC
S104
PERFORM SKEW CORRECTION OF PRECEDING SHEET
S105
PERFORM ALIGNMENT OF PRECEDING SHEET
SPEED: 15 INCHES/SEC
S106
START PRINTING OPERATION OF
FIRST SURFACE OF PRECEDING SHEET
S107
S108
HAS
PRINTING OPERATION OF FIRST SURFACE OF
PRECEDING SHEET BEEN COMPLETED
?
NO
YES
5
START TO INVERSION FEEDING OF PRECEDING SHEET
SPEED: 7.6 INCHES/SEC
S109
PERFORM SKEW CORRECTION OF INVERTED PRECEDING SHEET
S110
PERFORM ALIGNMENT OF INVERTED PRECEDING SHEET
SPEED: 15 INCHES/SEC
S111
START PRINTING OPERATION OF INVERTED PRECEDING SHEET
S112
1

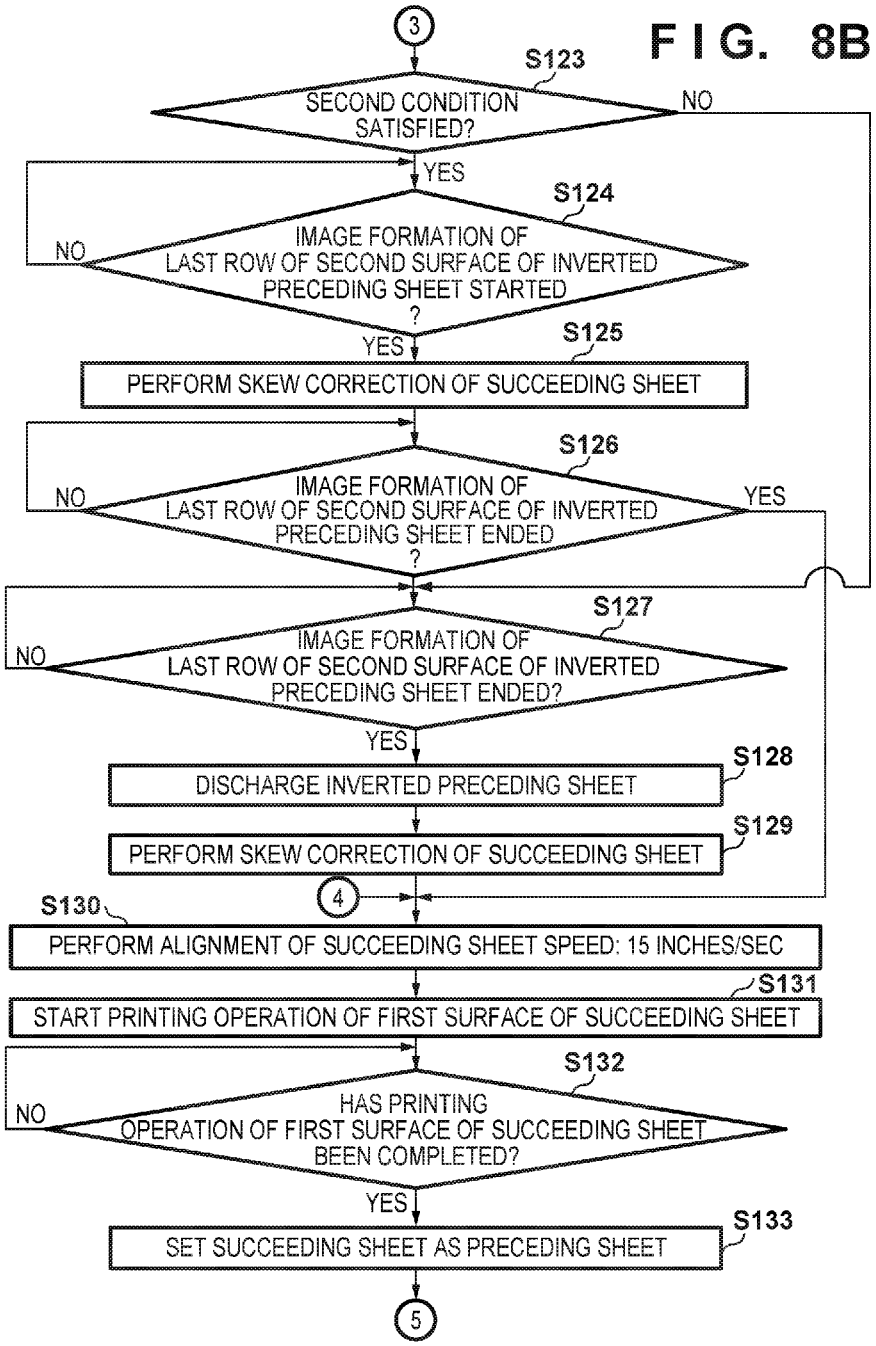
FIG. 8B
3
S123
SECOND CONDITION SATISFIED?
NO
YES
S124
IMAGE FORMATION OF LAST ROW OF SECOND SURFACE OF INVERTED PRECEDING SHEET STARTED ?
NO
YES
S125
PERFORM SKEW CORRECTION OF SUCCEEDING SHEET
S126
IMAGE FORMATION OF LAST ROW OF SECOND SURFACE OF INVERTED PRECEDING SHEET ENDED ?
NO
YES
S127
IMAGE FORMATION OF LAST ROW OF SECOND SURFACE OF INVERTED PRECEDING SHEET ENDED?
NO
YES
S128
DISCHARGE INVERTED PRECEDING SHEET
S129
PERFORM SKEW CORRECTION OF SUCCEEDING SHEET
4
S130
PERFORM ALIGNMENT OF SUCCEEDING SHEET SPEED: 15 INCHES/SEC
S131
START PRINTING OPERATION OF FIRST SURFACE OF SUCCEEDING SHEET
S132
HAS PRINTING OPERATION OF FIRST SURFACE OF SUCCEEDING SHEET BEEN COMPLETED?
NO
YES
S133
SET SUCCEEDING SHEET AS PRECEDING SHEET
5

PRINTING APPARATUS, CONTROL METHOD THEREFOR, AND NON-TRANSITORY COMPUTER-READABLE STORAGE MEDIUM

BACKGROUND OF THE INVENTION

Field of the Invention

The present invention relates to a printing apparatus.

Description of the Related Art

Successive overlapped conveyance of sheets has been proposed as a method of improving a printing speed of a printing apparatus. Successive overlapped conveyance is a conveyance method of conveying a plurality of sheets while the trailing edge of a preceding sheet and the leading edge of a succeeding sheet overlap each other when images are printed continuously on them (for example, Japanese Patent Laid-Open No. 2000-15881). Successive overlapped conveyance can further improve the printing speed as compared with a conveyance method of starting to feed the succeeding sheet after printing of the preceding sheet ends or a conveyance method of conveying sheets continuously while narrowing a gap between them.

As one of conventional printing apparatuses, a printing apparatus having a function of printing on both sides of a sheet has been proposed. When printing on both sides of the sheet, the printing speed is likely to feel slow as a whole because the sheet is printed for each side. In the apparatus of Japanese Patent Laid-Open No. 2000-15881, no consideration is given to an improvement in the printing speed in printing on both sides of the sheet.

SUMMARY OF THE INVENTION

The present invention provides a technique of improving a printing speed when two-sided printing of a plurality of sheets is performed continuously.

According to an aspect of the present invention, there is provided, for example, a printing apparatus comprising: a feeding unit configured to feed a sheet; a conveying unit configured to convey the sheet fed by the feeding unit; a printing unit configured to print the sheet conveyed by the conveying unit; an inversion path configured to invert the sheet printed on a first surface by the printing unit and convey the sheet to the conveying unit; and a conveyance control unit configured to perform conveyance control of overlapping a trailing edge of a preceding sheet conveyed through the inversion path and a leading edge of a succeeding sheet fed following the preceding sheet.

Further features of the present invention will become apparent from the following description of exemplary embodiments (with reference to the attached drawings).

BRIEF DESCRIPTION OF THE DRAWINGS

FIG. 5 shows views for explaining the operation of the printing apparatus in FIG. 1;

FIG. 7 is a flowchart illustrating an example of a process executed by the control unit of the printing apparatus in FIG. 1;

FIGS. 8A and 8B are flowcharts illustrating the example of the process executed by the control unit of the printing apparatus in FIG. 1;

DESCRIPTION OF THE EMBODIMENTS

Figure 1:
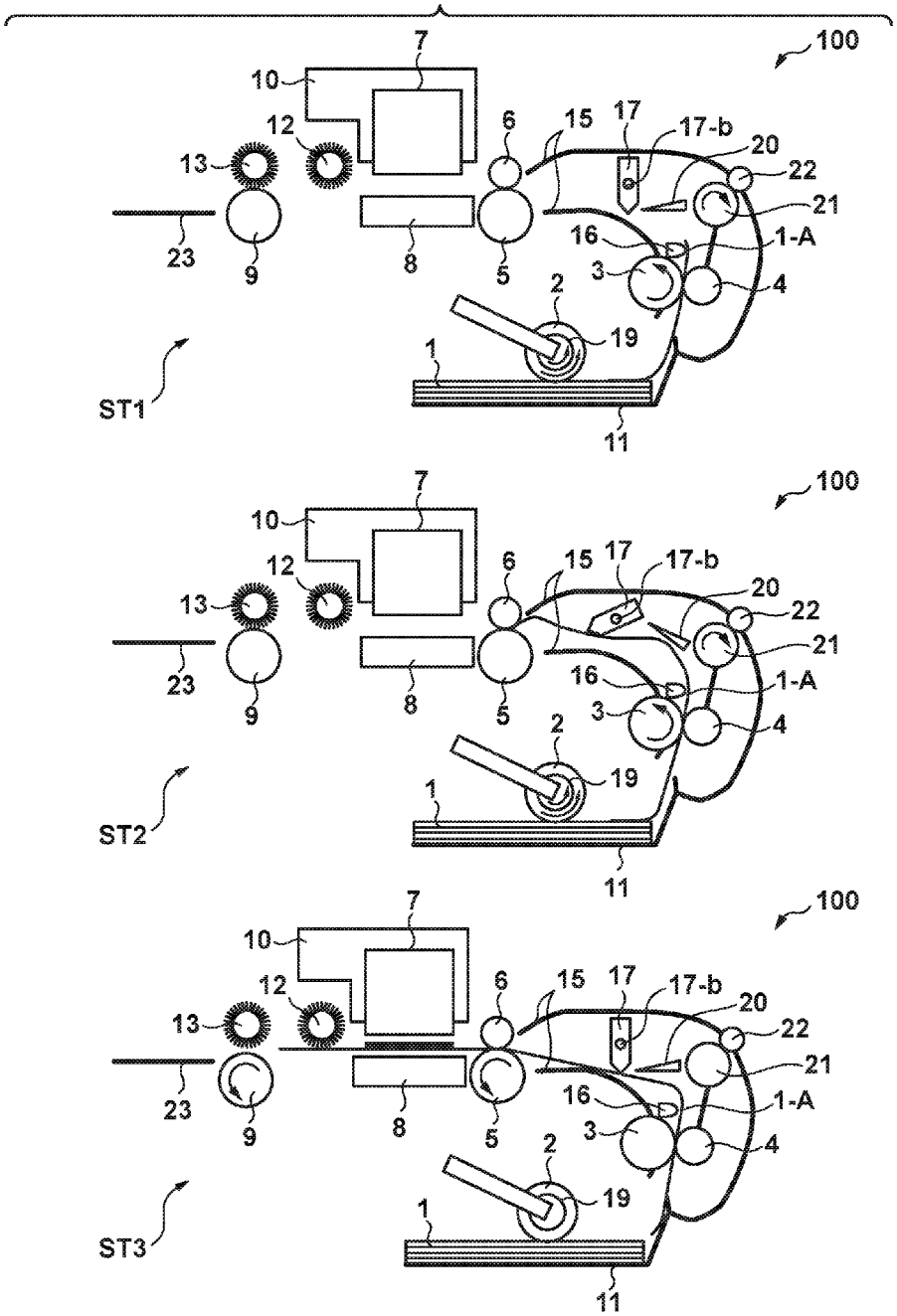
FIG. 1 shows views for explaining an operation of a printing apparatus according to an embodiment of the present invention.

FIGS. 1 to 5 are views for explaining an operation of a printing apparatus 100 according to an embodiment of the present invention. In particular, FIGS. 1 to 5 are views for explaining an operation of two-sided printing and successive overlapped conveyance. FIGS. 1 to 5 schematically show the sectional structure of the printing apparatus 100. In this embodiment, a case in which the present invention is applied to a serial-type inkjet printing apparatus will be described. However, the present invention is also applicable to a printing apparatus of another type.

Note that "print" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans. Additionally, in this embodiment, "printing medium" is assumed to be a paper sheet, but may be cloth, a plastic film, or the like. A sheet-like printing medium will be referred to as a printing sheet here.

Before explaining the operation of the printing apparatus 100, the arrangement thereof will be described mainly with reference to a state ST1 in FIG. 1. The printing apparatus 100 includes a feeding tray (stack section) that can stack a plurality of printing sheets 1, a printing unit which prints the printing sheets 1, and a conveying apparatus which conveys the printing sheets 1 from the feeding tray 11 to a discharge tray 23 (discharge section).

The printing unit includes a printhead 7 and a carriage 10. The printhead 7 prints the printing sheet 1. In this embodiment, the printhead 7 is an inkjet printhead which prints the printing sheet 1 by discharging ink. A platen 8 which supports the back surface of the printing sheet 1 is arranged at a position facing the printhead 7. The carriage 10 incorporates the printhead 7 and moves in a direction intersecting a conveyance direction.

The conveying apparatus is roughly divided into a feeding mechanism, a conveying mechanism, a discharging mechanism, and an inversion mechanism. The feeding mechanism feeds the printing sheets 1 to the conveying mechanism. The conveying mechanism conveys the fed printing sheets 1 to the discharging mechanism. The discharging mechanism conveys the printing sheets 1 to outside the printing apparatus 100. The conveying mechanism mainly conveys the printing sheet 1 being printed. As described above, the printing sheets 1 are sequentially conveyed by the feeding mechanism, the conveying mechanism, and the discharging mechanism. A side of the feeding mechanism will be referred to as an upstream side in the conveyance direction. A side of the discharging mechanism will be referred to as a downstream side in the conveyance direction. The inversion mechanism receives the printing sheet 1 printed on one side from the conveying mechanism, inverts and conveys the printing sheet 1 to the conveying mechanism, and is used for two-sided printing.

The feeding mechanism includes a pickup roller 2, a feeding roller 3, and a feeding driven roller 4. The pickup roller 2 rotates through a driving shaft 19, abuts against the top printing sheet 1 stacked on the feeding tray 11 to pick it up, and conveys it to the feeding roller 3. The feeding roller 3 is a driving roller for feeding the printing sheet 1 picked up by the pickup roller 2 to the downstream side in the conveyance direction. The feeding driven roller 4 is biased and pressed against the feeding roller 3 by an elastic member (for example, a spring) (not shown) to sandwich the printing sheet 1 with the feeding roller 3, thereby conveying the printing sheet 1.

Referring back to FIG. 1, the conveying mechanism includes a conveying roller 5 and a pinch roller 6. The conveying roller 5 and the pinch roller 6 form a conveying roller pair. The conveying roller 5 conveys the printing sheet 1 fed by the feeding roller 3 and the feeding driven roller 4 to the position facing the printhead 7. The pinch roller 6 is biased and pressed against the conveying roller 5 by the elastic member (for example, the spring) (not shown) to sandwich the printing sheet 1 with the conveying roller 5, thereby conveying the printing sheet 1. In printing, an image is printed on the printing sheet 1 by, for example, repeating a predetermined amount of conveyance of the printing sheet 1 by the conveying roller 5 and the pinch roller 6, and movement of the carriage 10 and ink discharge by the printhead 7 alternately.

The discharging mechanism includes a discharging roller 9, and spurs 12 and 13. The discharging roller 9 discharges the printing sheet 1 printed by the printhead 7 to the outside of the apparatus (to the discharge tray 23). The spurs 12 and 13 rotate while they are in contact with the printing surface of the printing sheet 1 printed by the printhead 7. The spur 13 on the downstream side is biased and pressed against the discharging roller 9 by the elastic member (for example, the spring) (not shown). No discharging roller 9 is arranged at a position facing the spur 12 on the upstream side. The spur 12 is used to prevent the floating of the printing sheet 1, and is also referred to as a pressing spur.

The printing apparatus 100 includes a sheet detection sensor 16. The sheet detection sensor 16 is a sensor configured to detect the leading edge and the trailing edge of the printing sheet 1 and is, for example, an optical sensor. The sheet detection sensor 16 is provided on the downstream side of the feeding roller 3 in the conveyance direction.

A sheet pressing lever 17 presses the trailing edge of the preceding printing sheet 1 (also referred to as a preceding printing medium or a preceding sheet) and makes the leading edge of the succeeding printing sheet 1 (also referred to as a succeeding printing medium or a succeeding sheet) overlap the trailing edge of the preceding printing sheet 1. Note that the leading edge and the trailing edge of the printing sheet 1 mean an edge on the downstream side and an edge on the upstream side, respectively, in the conveyance direction. The sheet pressing lever 17 is biased by the elastic member (for example, the spring) (not shown) around a rotating shaft 17*b* in a counterclockwise direction in FIG. 1.

The inversion mechanism includes a flapper 20, an inversion roller 21, and an inversion driven roller 22. In two-sided printing, the flapper 20 guides, to an inversion path, the printing sheet 1, which has already been printed on one side, conveyed in a backward direction by a conveyance nip portion. The flapper 20 is provided pivotally or elastically deformably and when the feeding roller 3 and the feeding driven roller 4 feed the printing sheet 1 to the conveyance nip portion, is raised by the printing sheet 1 and never prevents conveyance of the printing sheet 1.

The inversion roller 21 conveys, to the feeding roller 3, the printing sheet 1, which has already been printed on one side, conveyed in the backward direction from the conveying roller 5. The printing sheet 1 is inverted by being conveyed from the inversion roller 21 to the feeding roller 3. The inversion driven roller 22 is biased and pressed against the inversion roller 21 by the elastic member (for example, the spring) (not shown) to sandwich the printing sheet with the inversion roller 21, thereby conveying the printing sheet.

Conveying guides 15, which guide conveyance of the printing sheet 1, are provided in a conveyance section between a nip portion (referred to as a feeding nip portion), formed by the feeding roller 3 and the feeding driven roller 4, and a nip portion (referred to as the conveyance nip portion), formed by the conveying roller 5 and the pinch roller 6.

The conveying guides 15 include a portion (mainly, a lower portion in FIG. 1) that forms a normal path which guides the printing sheet 1 conveyed from the feeding nip portion to the conveyance nip portion. The conveying guides 15 also include a portion (mainly, an upper portion in FIG. 1) that forms an inversion path which guides the printing sheet 1 conveyed from the conveyance nip portion to the feeding nip portion.

Figure 6:
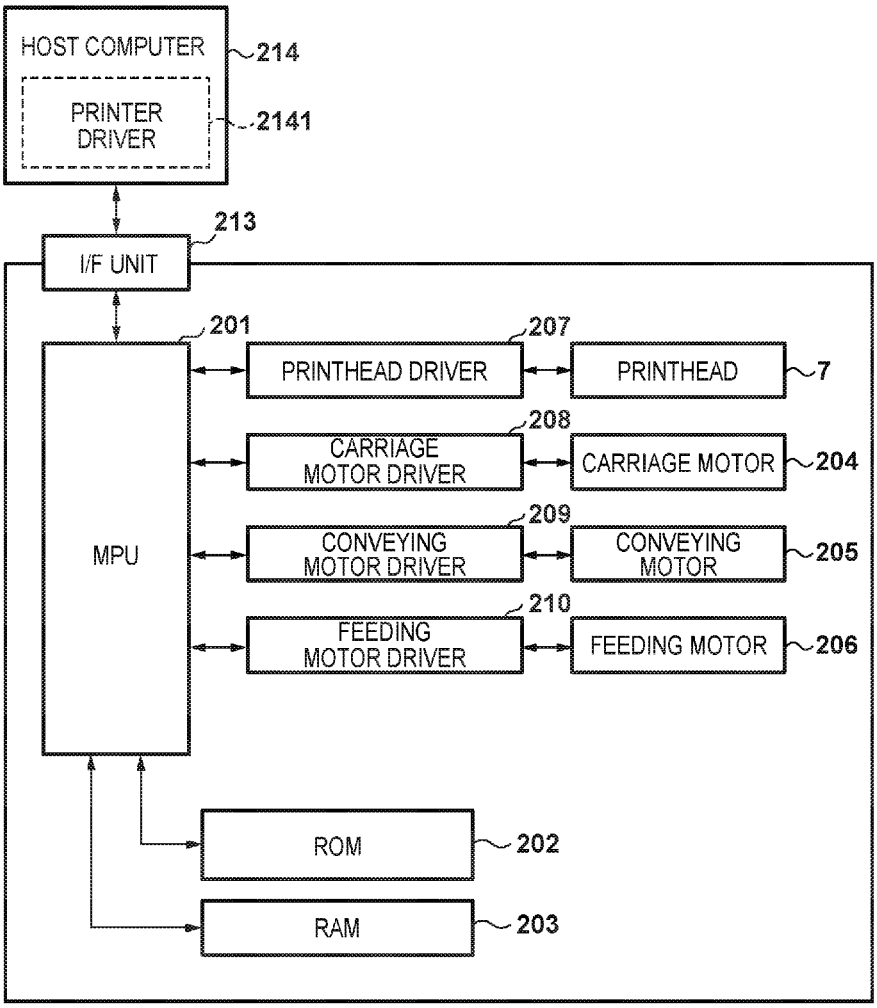
FIG. 6 is a block diagram showing a control unit of the printing apparatus in FIG. 1.

A control unit of the printing apparatus 100 will now be described. FIG. 6 is a block diagram showing the control unit of the printing apparatus 100.

The printing apparatus 100 includes a MPU 201. The MPU 201 can control the operation of each unit of the printing apparatus 100, and also performs data processing and the like. As will be described later, the MPU 201 can control conveyance of the printing sheets 1 so that the trailing edge of the preceding sheet and the leading edge of the succeeding sheet overlap each other. A ROM 202 stores data and programs to be executed by the MPU 201. A RAM 203 temporarily stores processing data to be executed by the MPU 201 and printing data received from a host computer 214. Note that other storage devices can also be used in place of the ROM 202 and the RAM 203.

A printhead driver 207 drives the printhead 7. A carriage motor driver 208 drives a carriage motor 204 serving as a driving source of a driving mechanism which moves the carriage 10. A conveying motor 205 serves as a driving source of a driving mechanism of the conveying roller 5 and the discharging roller 9. A conveying motor driver 209 drives the conveying motor 205.

A feeding motor 206 serves as a driving source of a driving mechanism of the pickup roller 2, the feeding roller 3, and the inversion roller 21. A feeding motor driver 210 drives the feeding motor 206. A driving force continuation mechanism (not shown) is provided between the feeding motor 206 and the driving shaft 19 of the pickup roller 2.

In a predetermined case, the driving force continuation mechanism shuts off transmission of a driving force to the driving shaft 19. This makes it possible not to rotate the pickup roller 2 while rotating the feeding roller 3 and the inversion roller 21. For example, the driving force continuation mechanism may be set in a non-transmission state after the conveying roller 5 is rotated in the backward direction by a predetermined amount, and then resumed to a transmission state after the conveying roller 5 is rotated in a forward direction by a predetermined amount. Alternatively, for example, the driving force continuation mechanism may include an electromagnetic actuator such as a solenoid, and switching between the non-transmission state and the transmission state may be done by the action of the electromagnetic actuator. Switching between the non-transmission state and the transmission state may be done by, for example, displacing some of gears which form a transmission mechanism of the driving force. Any arrangement may be possible as long as the MPU 201 can control that switching. In an initial state, the driving shaft 19 is set in the transmission state.

The MPU 201 controls a printing operation (ink discharge and movement of the printhead 7) by the printhead 7 through the printhead driver 207 and the carriage motor driver 208. The MPU 201 also controls conveyance of the printing sheet 1 through the conveying motor driver 209 and the feeding motor driver 210. A sensor (not shown) can detect the position of the printhead 7 and the rotation amount of the conveying roller 5 or the like.

In the host computer 214, a printer driver 2141 is used to communicate with the printing apparatus by collecting printing information such as a printing image and printing image quality when the user instructs the execution of a printing operation. The MPU 201 exchanges the printing image and the like with the host computer 214 through an I/F unit 213.

Operation Example

Conveyance control of the preceding sheet and the succeeding sheet when two-sided printing is performed on the printing sheet 1 will be described in time series with reference to FIGS. 1 to 5.

When the host computer 214 transmits printing data on a front surface through the I/F unit 213, the printing data is processed by the MPU 201, and then loaded into the RAM 203. The MPU 201 starts a printing operation based on the loaded data.

The description will be given with reference to a state ST1 of FIG. 1. At the beginning, the feeding motor driver 210 drives the feeding motor 206. This rotates the pickup roller 2. When the pickup roller 2 rotates, the top printing sheet (preceding sheet 1-A) stacked on the feeding tray 11 is picked up. The preceding sheet 1-A picked up by the pickup roller 2 is conveyed by the feeding roller 3 rotating in the same direction as that of the pickup roller 2. The feeding motor 206 also drives the feeding roller 3.

The sheet detection sensor 16 provided on the downstream side of the feeding roller 3 detects the leading edge of the preceding sheet 1-A.

The description will be given with reference to a state ST2 of FIG. 1. By continuously rotating the feeding roller 3, the leading edge of the preceding sheet 1-A pushes the flapper 20 upward to move downstream, and then rotates the sheet pressing lever 17 about the rotating shaft 17*b* in the clockwise direction against the biasing force of the spring. When the feeding roller 3 is further continuously rotated, the leading edge of the preceding sheet 1-A abuts against the conveyance nip portion formed by the conveying roller 5 and the pinch roller 6. At this time, the conveying roller 5 stops. By rotating the feeding roller 3 by a predetermined amount even after the leading edge of the preceding sheet 1-A abuts against the conveyance nip portion, alignment of the preceding sheet 1-A is performed to correct the skew while the leading edge of the preceding sheet 1-A abuts against the conveyance nip portion. The skew correcting operation will also be referred to as a registration adjustment operation.

The description will be given with reference to a state ST3 of FIG. 1. When the skew correcting operation of the preceding sheet 1-A ends, driving of the feeding motor 206 stops. Further, a transmission state of the driving force with respect to the driving shaft 19 is switched to a non-transmission state, thereby switching to a state in which the pickup roller 2 does not rotate. Then, the conveying motor 205 is driven to start rotation of the conveying roller 5. When the conveying roller 5 is rotated in a state in which the preceding sheet 1-A is sandwiched between both the conveyance nip portion and the feeding nip portion, the feeding roller 3 is rotated together, and the sheet is stretched between the conveying roller 5 and the feeding roller 3.

After the preceding sheet 1-A is aligned with the position facing the printhead 7, the printing operation is performed by discharging ink from the printhead 7 based on the printing data. Note that the alignment operation is performed by making the leading edge of the printing sheet abut against the conveyance nip portion to temporarily position the printing sheet at the position of the conveying roller 5, and then controlling the rotation amount of the conveying roller 5 with reference to the position of the conveying roller 5. Thereafter, the position of the preceding sheet 1-A can be recognized, in terms of control, based on the rotation amount of the conveying roller 5 with reference to the position of the conveying roller 5.

Figure 2:
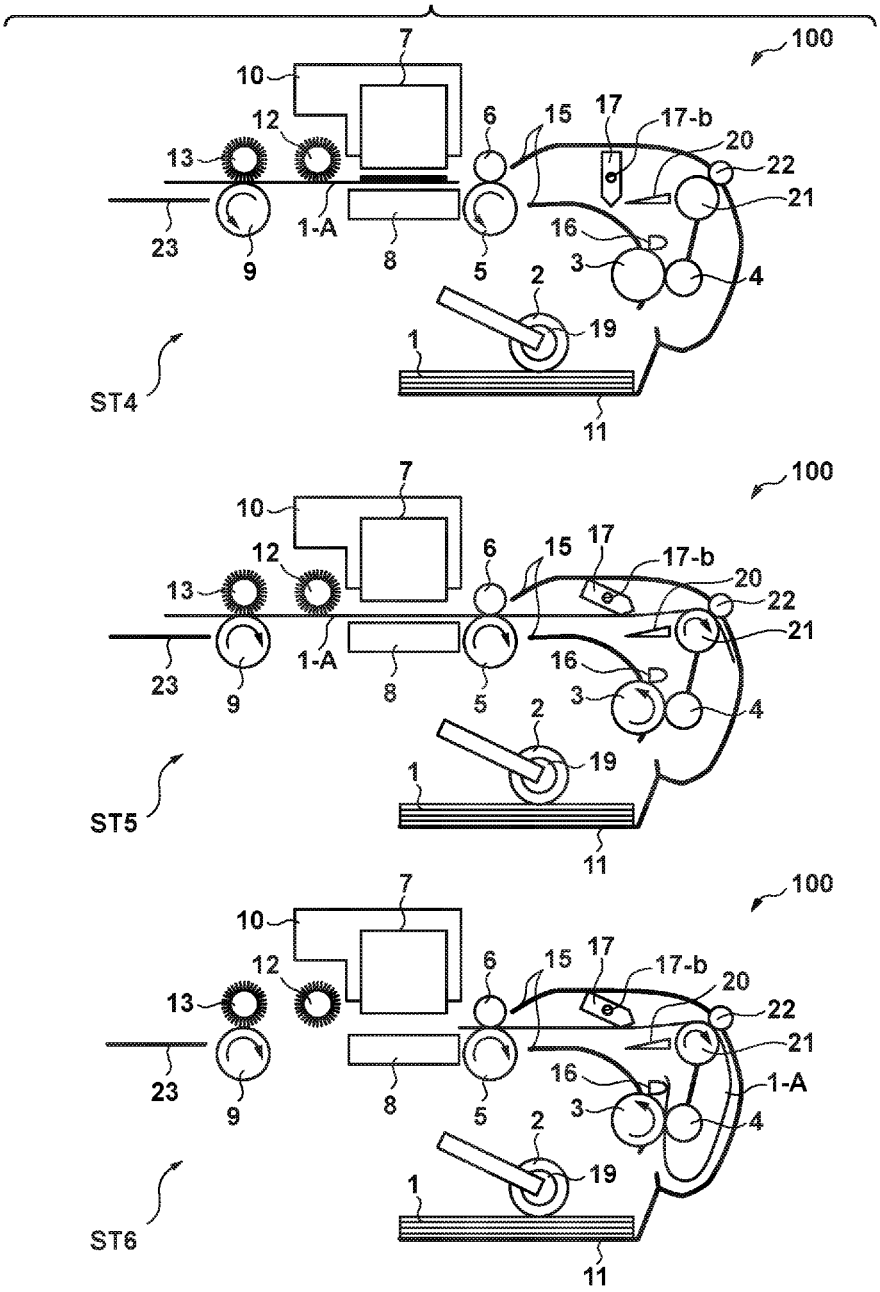
FIG. 2 shows views for explaining the operation of the printing apparatus in FIG. 1.

The description will be given with reference to a state ST4 of FIG. 2. The printing apparatus of this embodiment is the serial type printing apparatus in which the carriage 10 mounts the printhead 7. An image is printed on one side of the preceding sheet 1-A by a printing operation of repeating a conveying operation and an image forming operation. The conveying operation performs intermittent conveyance of the printing sheet 1 by a predetermined amount using the conveying roller 5. The image forming operation discharges ink from the printhead 7 while moving the carriage 10 incorporating the printhead 7 when the conveying roller 5 stops. Consequently, the image is printed on the first surface (the upper surface in FIG. 2) of the preceding sheet 1-A.

The description will be given with reference to a state ST5 of FIG. 2. After the printing operation of the first surface of the preceding sheet 1-A is complete, backward rotations of the conveying roller 5 and the discharging roller 9 start. The trailing edge of the preceding sheet 1-A rotates the sheet pressing lever 17 about the rotating shaft 17*b* in the counterclockwise direction and moves on the flapper 20. When the conveying roller 5 is further continuously rotated in the backward direction, the trailing edge of the preceding sheet 1-A is conveyed to the inversion feeding nip portion formed by the inversion roller 21 and the inversion driven roller 22.

Driving of the feeding motor 206 starts in accordance with the backward rotations of the conveying roller 5 and the discharging roller 9. This rotates the feeding roller 3 and rotates the inversion roller 21 in the same direction as the backward rotation direction of the conveying roller 5, conveying the printing sheet. Even if driving of the feeding motor 206 starts, the pickup roller 2 never rotates because it is set in a nonrotating state in the state ST3 of FIG. 1.

The description will be given with reference to a state ST6 of FIG. 2. By further continuously rotating the inversion roller 21 and the feeding roller 3, the preceding sheet 1-A is conveyed to the feeding nip portion. Once the preceding sheet 1-A reaches the feeding nip portion, driving of the conveying motor 205 stops to stop the conveying roller 5 and the discharging roller 9.

Comparing with the state ST2 of FIG. 1 in which the preceding sheet 1-A is picked up from the feeding tray 11 at this time, the leading edge and the trailing edge of the sheet are interchanged. That is, the front surface and the back surface are reversed at the position facing the printhead 7, and the second surface faces the printhead 7 with the first surface facing downward and the second surface facing upward. In order to avoid confusion in a direction such as the interchange of the leading edge and the trailing edge of the preceding sheet 1-A before and after the inversion, the preceding sheet 1-A after the inversion may be referred to as the inverted preceding sheet 1-A for the purpose of distinguishing it from the preceding sheet 1-A before the inversion.

Figure 3:
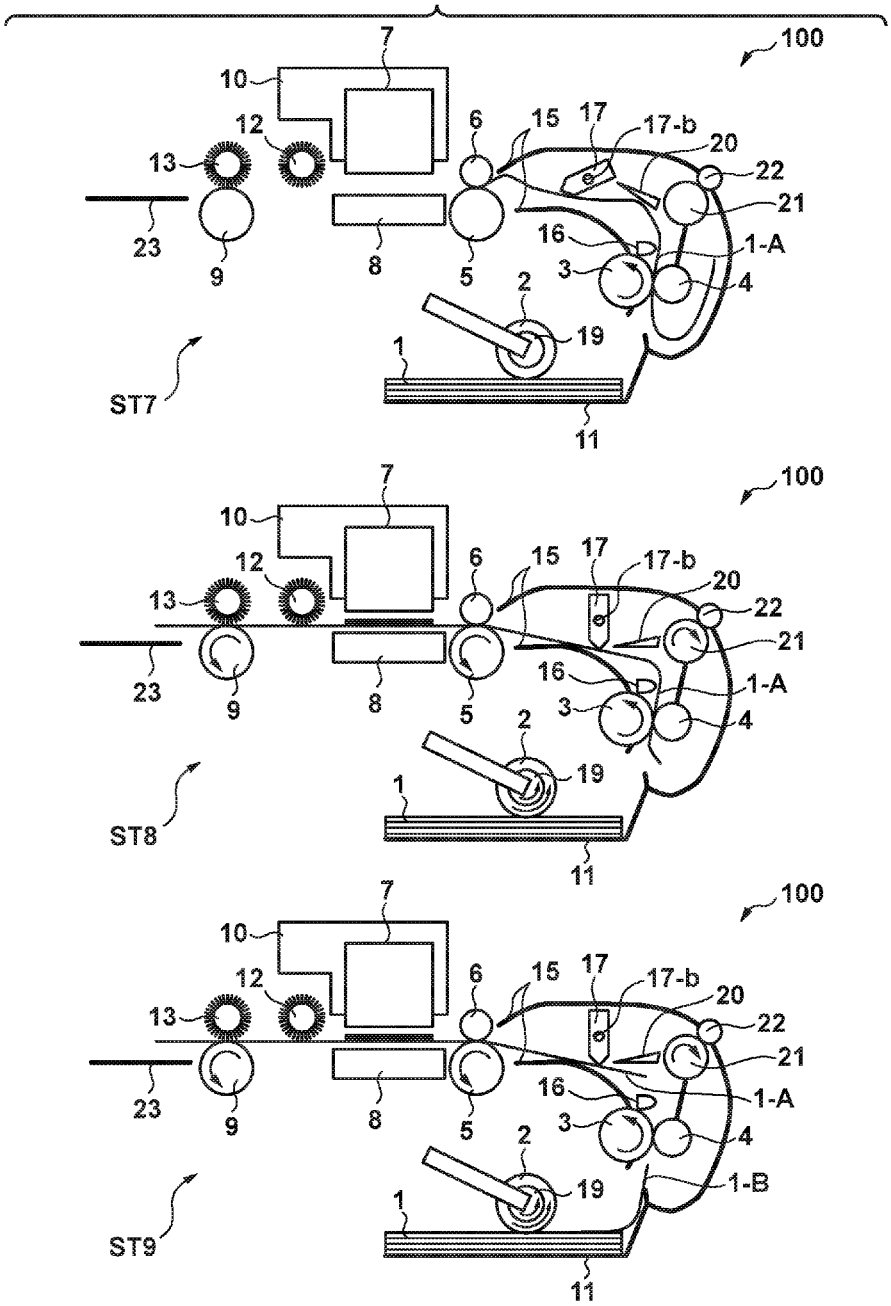
FIG. 3 shows views for explaining the operation of the printing apparatus in FIG. 1.

The description will be given with reference to a state ST7 of FIG. 3. By further continuously rotating the feeding roller 3, the leading edge of the inverted preceding sheet 1-A rotates the sheet pressing lever 17 about the rotating shaft 17*b* in the clockwise direction and moves downstream, performing the registration adjustment operation of the inverted preceding sheet 1-A. Thereafter, the position of the inverted preceding sheet 1-A can be recognized, in terms of control, based on the rotation amount of the conveying roller 5 with reference to the position of the conveying roller 5.

The description will be given with reference to a state ST8 of FIG. 3. When the host computer 214 transmits printing data on the second surface, the inverted preceding sheet 1-A is aligned with the position facing the printhead 7. Then, the printing operation is performed on the second surface of the inverted preceding sheet 1-A by discharging ink from the printhead 7 based on the printing data. In accordance with alignment of the inverted preceding sheet 1-A, the transmission state of the driving force with respect to the driving shaft 19 is switched from the non-transmission state to the transmission state, thereby switching to the state in which the pickup roller 2 rotates.

The description will be given with reference to a state ST9 of FIG. 3. Once the trailing edge of the inverted preceding sheet 1-A passes through a predetermined position, the feeding motor 206 is driven to start intermittent driving of the pickup roller 2 and the feeding roller 3. Consequently, the printing sheet 1 (succeeding sheet 1-B) is newly conveyed from the feeding tray 11. The trailing edge position of the inverted preceding sheet 1-A is determined by the rotation amount of the conveying roller 5 after the registration adjustment operation with reference to the position of the conveying roller 5.

Intermittent driving of the pickup roller 2 and the feeding roller 3 also rotates the pickup roller 2 and the feeding roller 3 when rotating the conveying roller 5, and also stops the pickup roller 2 and the feeding roller 3 when stopping the conveying roller 5. The rotation speed of the feeding roller 3 is lower than that of the conveying roller 5. Consequently, the inverted preceding sheet 1-A is stretched between the conveying roller 5 and the feeding roller 3. The feeding roller 3 is rotated together with the inverted preceding printing sheet 1-A conveyed by the conveying roller 5.

Figure 4:
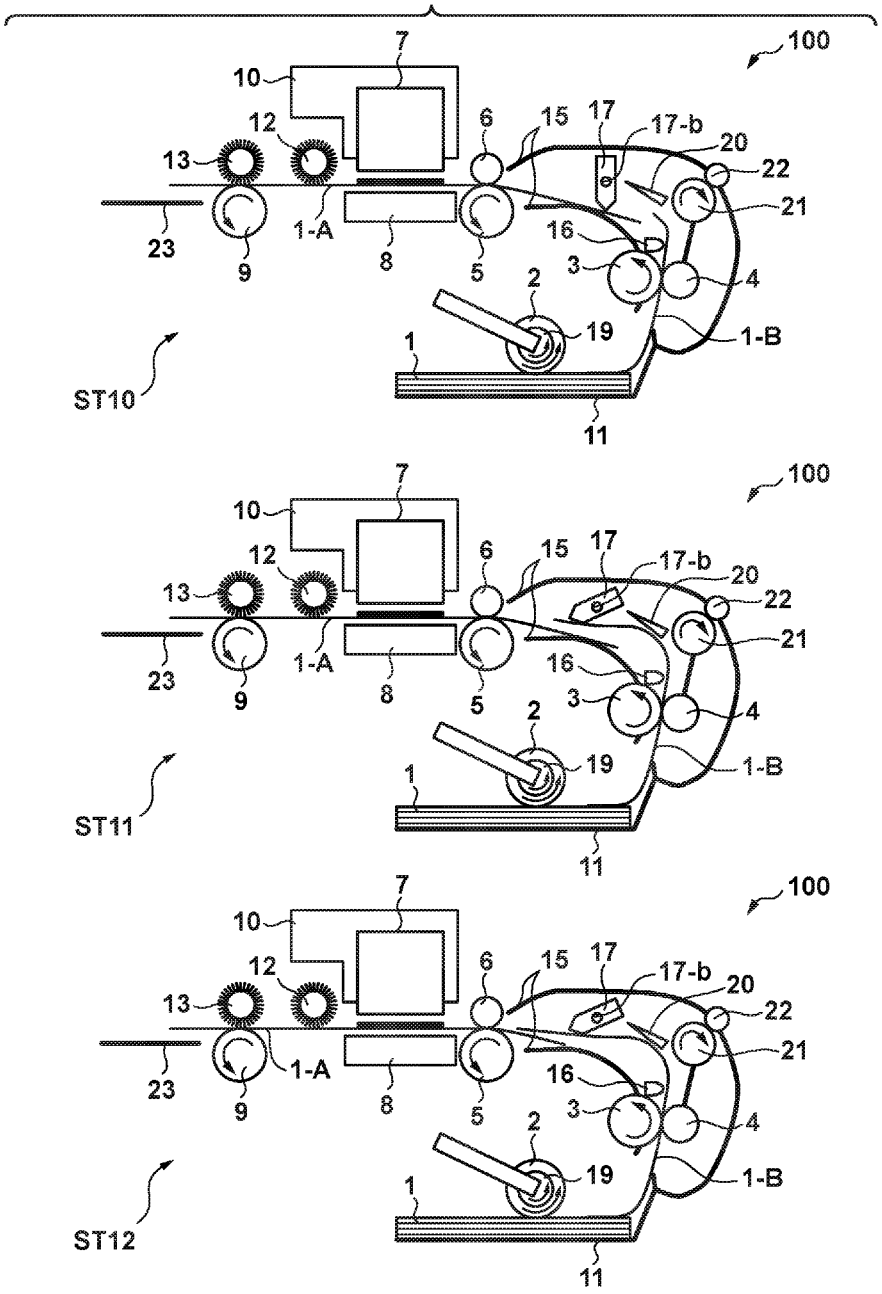
FIG. 4 shows views for explaining the operation of the printing apparatus in FIG. 1.

The description will be given with reference to a state ST10 of FIG. 4. The second surface of the inverted preceding sheet 1-A undergoes the image forming operation by the printhead 7 based on the printing data. Once the trailing edge of the preceding sheet 1-A passes through the feeding nip portion by intermittent conveyance of the conveying roller 5, intermittent driving of the pickup roller 2 and the feeding roller 3 stops to continuously rotate the pickup roller 2 and the feeding roller 3, and feed the succeeding sheet 1-B. The sheet detection sensor 16 provided on the downstream side of the feeding roller 3 detects the leading edge of the succeeding sheet 1-B.

The description will be given with reference to a state ST11 of FIG. 4. The sheet pressing lever 17 presses the trailing edge of the inverted preceding sheet 1-A downward, as shown in the state ST10 of FIG. 4. The succeeding sheet 1-B is moved at a speed higher than that at which the inverted preceding sheet 1-A moves downstream by the printing operation. This makes it possible to form a state in which the leading edge of the succeeding sheet 1-B overlaps the trailing edge of the inverted preceding sheet 1-A.

The description will be given with reference to a state ST12 of FIG. 4. The succeeding sheet 1-B is fed by the feeding roller 3 until its leading edge stops at a predetermined position upstream of the conveyance nip portion. The position of the leading edge of the succeeding sheet 1-B is calculated from the rotation amount of the feeding roller 3 after the sheet detection sensor 16 detects the leading edge of the succeeding sheet 1-B, and controlled based on the calculation result.

The description will be given with reference to a state ST13 of FIG. 5. When the conveying roller 5 stops to perform the image forming operation of the inverted preceding sheet 1-A (here, during the stop for the image forming operation of the last row), the feeding roller 3 is driven. This makes the leading edge of the succeeding sheet 1-B abut against the conveyance nip portion, thereby performing the skew correcting operation of the succeeding sheet 1-B. When the skew correcting operation of the succeeding sheet 1-B ends, driving of the feeding motor 206 stops. Further, the transmission state of the driving force with respect to the driving shaft 19 is switched to the non-transmission state, thereby switching to the state in which the pickup roller 2 does not rotate.

The description will be given with reference to a state ST14 of FIG. 5. When the image forming operation of the second surface of the inverted preceding sheet 1-A ends, the conveying roller 5 is rotated by a predetermined amount. Consequently, in a state in which the leading edge of the succeeding sheet 1-B overlaps the trailing edge of the inverted preceding sheet 1-A conveyed through the inversion path, successive overlapped conveyance of conveying that overlap portion while sandwiching it by the conveying roller 5 and the pinch roller 6 is performed.

Subsequently, alignment of the succeeding sheet 1-B is performed, and the succeeding sheet 1-B undergoes the printing operation based on the printing data. When the succeeding sheet 1-B undergoes intermittent conveyance for the printing operation, the inverted preceding sheet 1-A also undergoes intermittent conveyance, and is finally discharged to the discharge tray 23 by the discharging roller 9.

Thereafter, two-sided printing and successive overlapped conveyance of the printing sheets 1 are performed by the same procedure. This makes it possible to improve the printing speed when two-sided printing of the plurality of sheets 1 is performed continuously.

One-sided printing and successive overlapped conveyance in that case are not particularly described. It is also possible, however, to perform successive overlapped conveyance in one-sided printing by almost the same procedure as a part of the procedure in two-sided printing.

Process Example

An example of a process executed by the MPU 201 in order to implement the operations shown in FIGS. 1 to 5 will be described. FIGS. 7 to 9 are flowcharts illustrating the example of the process executed by the MPU 201 and show a control example of the printing apparatus 100.

When the host computer 214 transmits an instruction of printing on both sides of the printing sheet in step S101 of FIG. 7, the MPU 201 starts controlling this flowchart.

In step S102, the feeding operation of the preceding sheet 1-A starts. More specifically, the MPU 201 drives the feeding motor 206 at low speed through the feeding motor driver 210. In low-speed driving, the pickup roller 2 and the feeding roller 3 rotate at 7.6 inches/sec. The pickup roller 2 picks up the preceding sheet 1-A from the feeding tray 11. The feeding roller 3 feeds the preceding sheet 1-A toward the printhead 7.

In step S103, the sheet detection sensor 16 detects the leading edge of the preceding sheet 1-A. When the sheet detection sensor 16 detects the leading edge of the preceding sheet 1-A, the MPU 201 switches the feeding motor 206 to high-speed driving through the feeding motor driver in step S104. In high-speed driving, the pickup roller 2 and the feeding roller 3 rotate at 20 inches/sec. By controlling the rotation amount of the feeding motor 206 after the sheet detection sensor 16 detects the leading edge of the preceding sheet 1-A, the skew correcting operation of the preceding sheet 1-A is performed in step S105. When the skew correcting operation of the preceding sheet 1-A ends, driving of the feeding motor 206 stops. Further, the transmission state of the driving force with respect to the driving shaft 19 is switched to the non-transmission state.

When the host computer 214 transmits the printing data on the first surface, alignment of the preceding sheet 1-A is performed based on the printing data on the first surface in step S106. The MPU 201 controls the rotation amount of the conveying motor 205 through the conveying motor driver 209. The conveying roller 5 rotates at 15 inches/sec. Then, based on the printing data, the preceding sheet 1-A is conveyed to a printing start position with reference to the position of the conveying roller 5.

In step S107, a printing operation of the first surface of the preceding sheet 1-A starts when the printhead 7 discharges ink. More specifically, a conveying operation of performing intermittent conveyance of the preceding sheet 1-A by the conveying roller 5 by controlling the rotation amount of the conveying motor 205 and an operation of moving the carriage 10 by controlling the rotation amount of the carriage motor 204 through the carriage motor driver are performed. Further, based on the printing data loaded into the RAM 203, the printing operation of the preceding sheet 1-A is performed by repeating an image forming operation (ink discharge operation) of discharging ink from the printhead 7 through the printhead driver.

The process stands by for completion of the printing operation of the first surface of the preceding sheet 1-A in step S108. Upon completion of the printing operation, an inversion feeding operation of the preceding sheet 1-A starts in step S109. The conveying motor 205 and the feeding motor 206 are driven at low speed. The conveying roller 5 and the inversion roller 21 rotate at 7.6 inches/sec. The conveying motor 205 rotates the conveying roller 5 in a direction opposite to that of intermittent conveyance in the printing operation to convey the preceding sheet 1-A in the backward direction.

Once the preceding sheet 1-A reaches the feeding roller 3 through the inversion roller 21, driving of the conveying motor 205 stops. The preceding sheet 1-A is inverted. By continuously rotating the feeding roller 3, the sheet detection sensor 16 detects the leading edge of the inverted preceding sheet 1-A. Then, the skew correcting operation of the preceding sheet 1-A is performed in step S110 by controlling the rotation amount of the feeding motor 206.

In step S111, the conveying motor 205 is driven while controlling its rotation amount when the host computer 214 transmits the printing data on the second surface. The conveying roller 5 rotates at 15.0 inches/sec to perform alignment of the inverted preceding sheet 1-A. Further, the transmission state of the driving force with respect to the driving shaft 19 is switched from the non-transmission state to the transmission state. In step S112, the printing operation of the second surface of the preceding sheet 1-A starts.

Figure 8A:
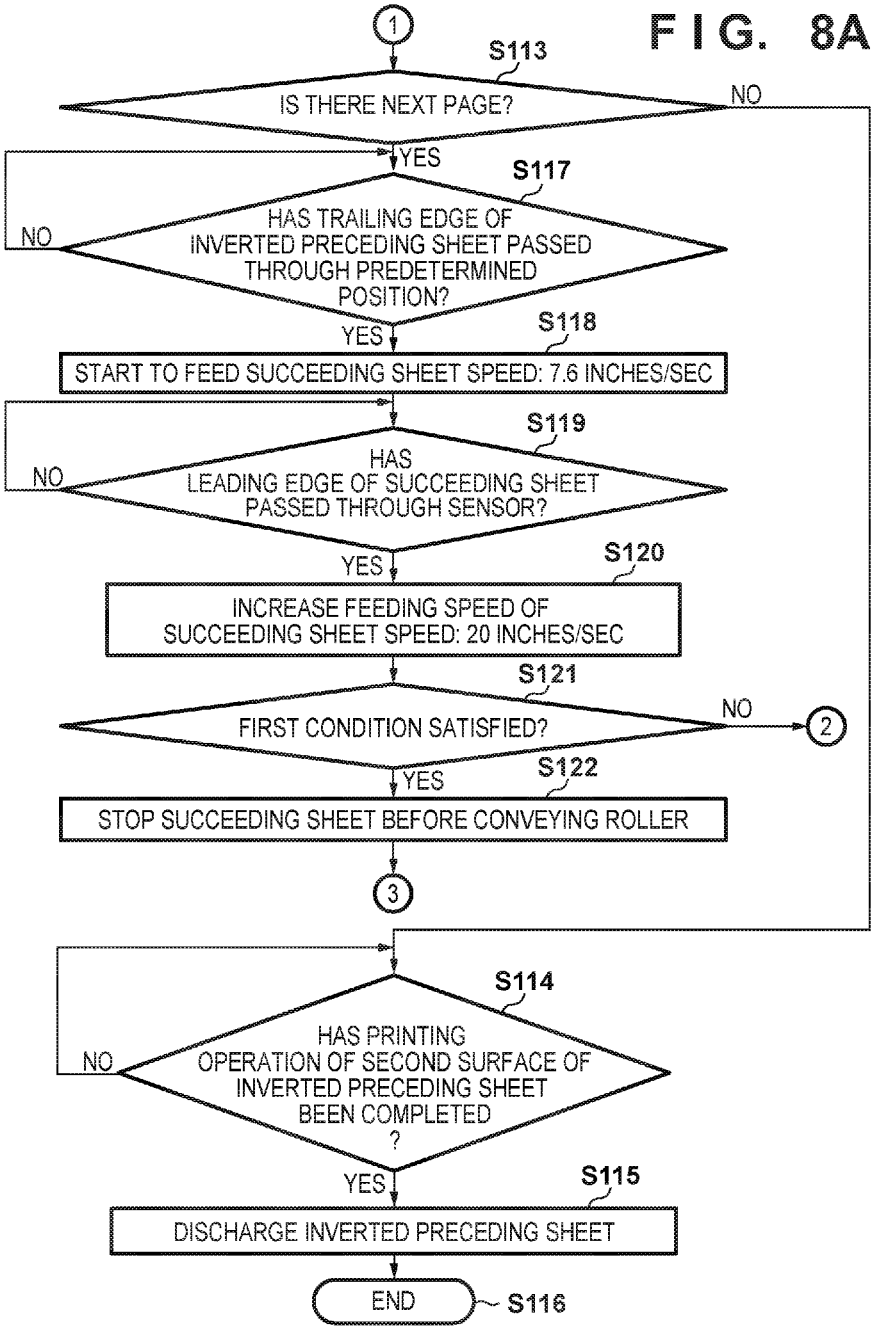
Figure 9:
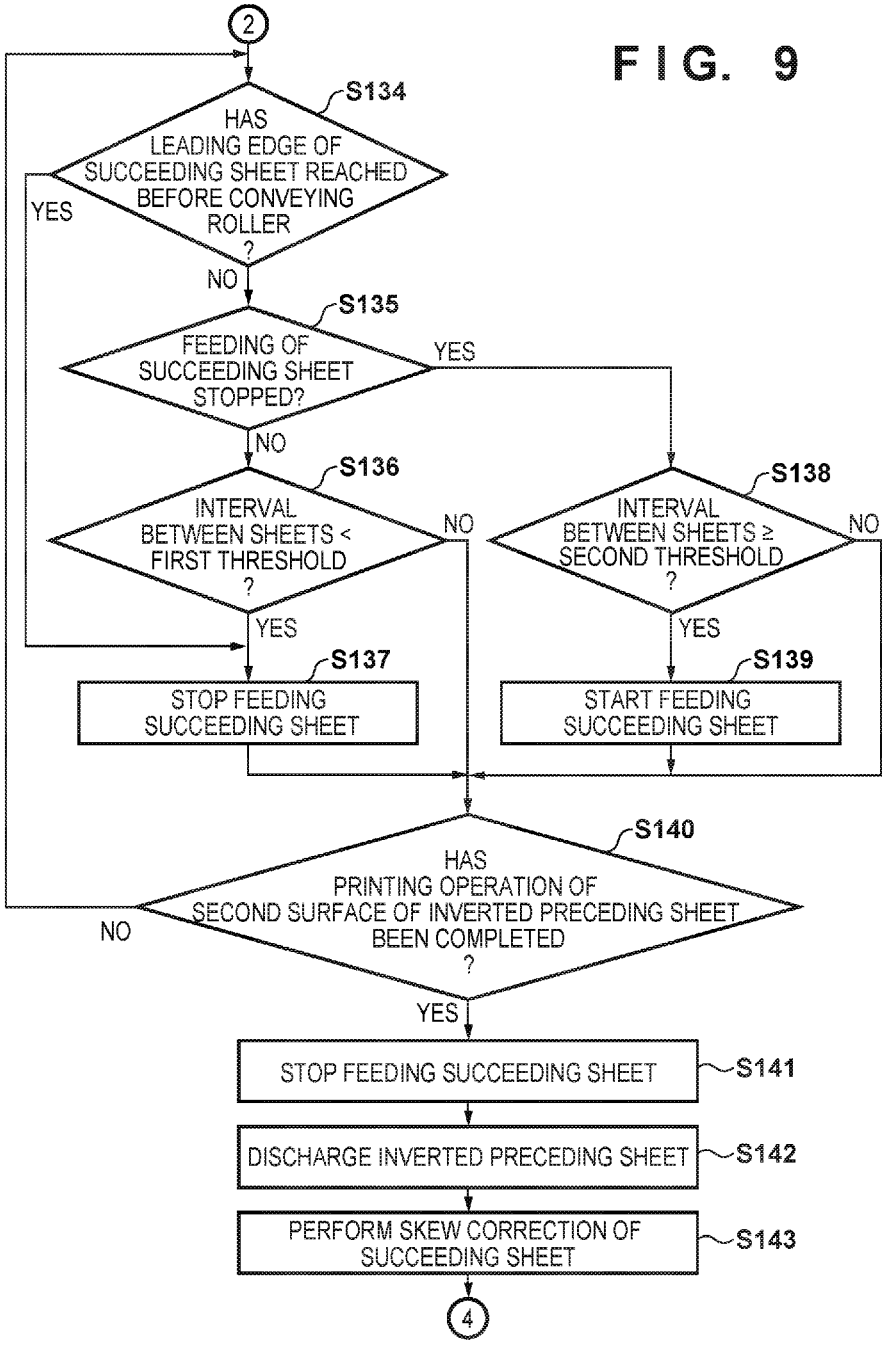
FIG. 9 is a flowchart illustrating the example of the process executed by the control unit of the printing apparatus in FIG. 1.

In step S113 of FIG. 8A, it is determined whether there is printing data of the next page. The host computer 214 transmits information on whether there is the printing data of the next page. If there is no printing data of the next page, the process advances to step S114. The process stands by for completion of the printing operation of the second surface of the preceding sheet 1-A in step S114. Upon completion of the printing operation, the preceding sheet 1-A is discharged in step S115, and this process ends in step S116.

If there is the printing data of the next page in step S113, it is determined, in step S117, whether the trailing edge of the inverted preceding sheet 1-A passes through the predetermined position. The trailing edge position of the inverted preceding sheet 1-A can be calculated by adding the size of the printing sheet 1 from the leading edge position. The leading edge position is defined by the distance from the conveyance nip portion and calculated by the rotation amount of the conveying motor 5 after the skew correcting operation.

Once the trailing edge of the inverted preceding sheet 1-A passes through the predetermined position, the feeding operation of the succeeding sheet 1-B starts in step S118. The predetermined position can be a position at which a predetermined interval is formed between the inverted preceding sheet 1-A and the succeeding sheet 10B, and is set by, for example, the distance between the feeding roller 3 and the feeding tray 11. The succeeding sheet 1-B can be fed more quickly by, regardless of whether to perform successive overlapped conveyance, starting the feeding operation of the succeeding sheet 1-B after the trailing edge of the inverted preceding sheet 1-A passes through the predetermined position.

In step S118, the pickup roller 2 picks up the succeeding sheet 1-B, and the feeding roller 3 feeds the succeeding sheet 1-B toward the printhead 7. The feeding motor 206 is driven at low speed. The pickup roller 2 and the feeding roller 3 rotate at 7.6 inches/sec.

In step S119, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S120. That is, the pickup roller 2 and the feeding roller 3 rotate at 20 inches/sec. The leading edge position of the succeeding sheet is controlled by using the rotation amount of the feeding motor 206 after the sheet detection sensor 16 detects the leading edge of the succeeding sheet 1-B.

In step S121, it is determined whether the first condition is satisfied. If the first condition is satisfied, the process advances to step S122. If the first condition is not satisfied, the process advances to step S134 in FIG. 9. At this determination stage, the succeeding sheet 1-B is positioned away from the inverted preceding sheet 1-A. After this, in step S121, it is determined whether to convey the succeeding sheet 1-B to a position where the trailing edge of the inverted preceding sheet 1-A and the leading edge of the succeeding sheet 1-B overlap each other as shown in the state ST11 of FIG. 4. A detail of the determination will be described later.

In step S122, the succeeding sheet 1-B is conveyed so that its leading edge reaches a position a predetermined amount before the conveyance nip portion. Upon reaching that position, driving of the feeding motor 206 stops to stop feeding the succeeding sheet 1-B.

In step S123, it is determined whether the second condition is satisfied. If the second condition is satisfied, the process advances to step S124. If the second condition is not satisfied, the process advances to step S127. At this determination stage, the succeeding sheet 1-B is at a position before the conveyance nip portion, and where the leading edge of the succeeding sheet 1-B overlaps the trailing edge of the preceding sheet 1-A as described with reference to the state ST12 of FIG. 4. After this, in step S123, it is determined whether the skew correcting operation and successive overlapped conveyance of the succeeding sheet 1-B can be performed as shown in the state ST12 and the state ST13 of FIG. 5. In this embodiment, by conveying the succeeding sheet 1-B to a position at which its leading edge overlaps the trailing edge of the preceding sheet 1-A regardless of whether to perform successive overlapped conveyance, printing of the succeeding sheet 1-B is started early even if successive overlapped conveyance is not performed. A detail of the determination in step S123 will be described later.

In step S124, the printing operation is performed until a stage at which image formation of the last row of the second surface of the inverted preceding sheet 1-A starts. In step S125, the skew correcting operation of the succeeding sheet 1-B is performed, as shown in the state ST12 of FIG. 5. Further, the transmission state of the driving force with respect to the driving shaft 19 is switched from the transmission state to the non-transmission state. In step S126, the printing operation is performed until image formation of the last row of the second surface of the inverted preceding sheet 1-A ends. Then, the process advances to step S130.

Successive overlapped conveyance is not performed in the process in steps S127 to S129. In step S127, the printing operation is performed until the printing operation of the second surface of the inverted preceding sheet 1-A ends. In step S128, the conveying motor 205 is driven to discharge the inverted preceding sheet 1-A. After the preceding sheet 1-A is discharged, driving of the conveying motor 205 stops. In step S129, the feeding motor 206 is driven while the conveying roller 5 stops, and the skew correcting operation of the succeeding sheet 1-B is performed. Further, the transmission state of the driving force with respect to the driving shaft 19 is switched from the transmission state to the non-transmission state.

When the host computer 214 transmits the printing data on the front surface of the next page, alignment of the succeeding sheet 1-B is performed based on the printing data in step S130, and the printing operation of the first surface of the succeeding sheet 1-B starts in step S131.

In step S132, the process stands by for completion of the printing operation of the first surface of the succeeding sheet 1-B. In step S133, the succeeding sheet 1-B is set as the preceding sheet 1-A. Then, the process returns to step S109. The succeeding sheet 1-B is replaced by the inverted preceding sheet 1-A in terms of control, and the aforementioned control will be repeated hereinafter. Consequently, two-sided printing of the plurality of printing sheets 1 is performed continuously.

The process in steps S134 to S143 of FIG. 9 is performed when it is determined in step S121 that the succeeding sheet 1-B is not conveyed to the position where the trailing edge of the inverted preceding sheet 1-A and the leading edge of the succeeding sheet 1-B overlap each other. In this case, the printing speed is improved by conveying the succeeding sheet 1-B while maintaining the distance between the sheets within a predetermined range.

In step S134, it is determined whether the leading edge of the succeeding sheet 1-B has reached a position a predetermined amount before the conveying roller 5 (the same position as a determination position in step S122). If the leading edge has reached that position, the process advances to step S137. If the leading edge has not reached that position, the process advances to step S135. In step S135, a feeding state of the succeeding sheet 1-B is checked. If the succeeding sheet 1-B is being fed (conveyed), the process advances to step S136. If feeding (conveyance) of the succeeding sheet 1-B is being stopped, the process advances to step S138.

In step S136, the interval between the trailing edge of the inverted preceding sheet 1-A and the leading edge of the succeeding sheet 1-B is calculated to determine whether that interval is smaller than the first threshold. If the interval is smaller than the first threshold, the process advances to step S137. If the interval is equal to or larger than the threshold, the feeding continues. In step S137, feeding of the succeeding sheet 1-B stops.

In step S138, the interval between the trailing edge of the inverted preceding sheet 1-A and the leading edge of the succeeding sheet 1-B is calculated to determine whether that interval is equal to or larger than the second threshold. If the interval is equal to or larger than the threshold, feeding of the succeeding sheet 1-B resumes in step S139. If the interval is smaller than the threshold, a stop state continues.

With this control, a constant interval is secured between the inverted preceding sheet 1-A and the succeeding sheet 1-B. The inverted preceding sheet 1-A and the succeeding sheet 1-B are conveyed apart from each other while maintaining a relationship of a slight distance between them. This can prevent the jam of the succeeding sheet 1-B or a long delay in feeding the succeeding sheet 1-B. Note that the first threshold and the second threshold may be the same or different in value, but can be in the relationship of the first threshold the second threshold.

It is determined in step S140 whether the printing operation of the second surface of the inverted preceding sheet 1-A is complete. If the printing operation is not complete, the process returns to step S134. If the printing operation is complete, the process advances to step S141.

In step S142, the conveying motor 205 is driven to discharge the inverted preceding sheet 1-A. After the preceding sheet 1-A is discharged, driving of the conveying motor 205 stops. The feeding motor 206 is driven while the conveying roller 5 stops, and the skew correcting operation of the succeeding sheet 1-B is performed in step S143. Further, the transmission state of the driving force with respect to the driving shaft 19 is switched from the transmission state to the non-transmission state. Then, the process advances to step S130.

<Determination of First Condition>

The determination in step S121 will be described in detail. For the inverted preceding sheet 1-A, the image has already been printed on its first surface, and its trailing edge may be deformed by that influence. For example, for the inkjet printing apparatus as in this embodiment, a wrinkle or a curl may be formed on the printing sheet depending on the amount of ink used for image printing or the property of the sheet. If the trailing edge of the inverted preceding sheet 1-A has the wrinkle or the curl, the succeeding sheet 1-B may be jammed without its leading edge being overlapped properly. In step S121, by determining the possibility of this failure and changing subsequent conveyance control, it is possible to prevent a sheet jam or the like.

Figure 10:
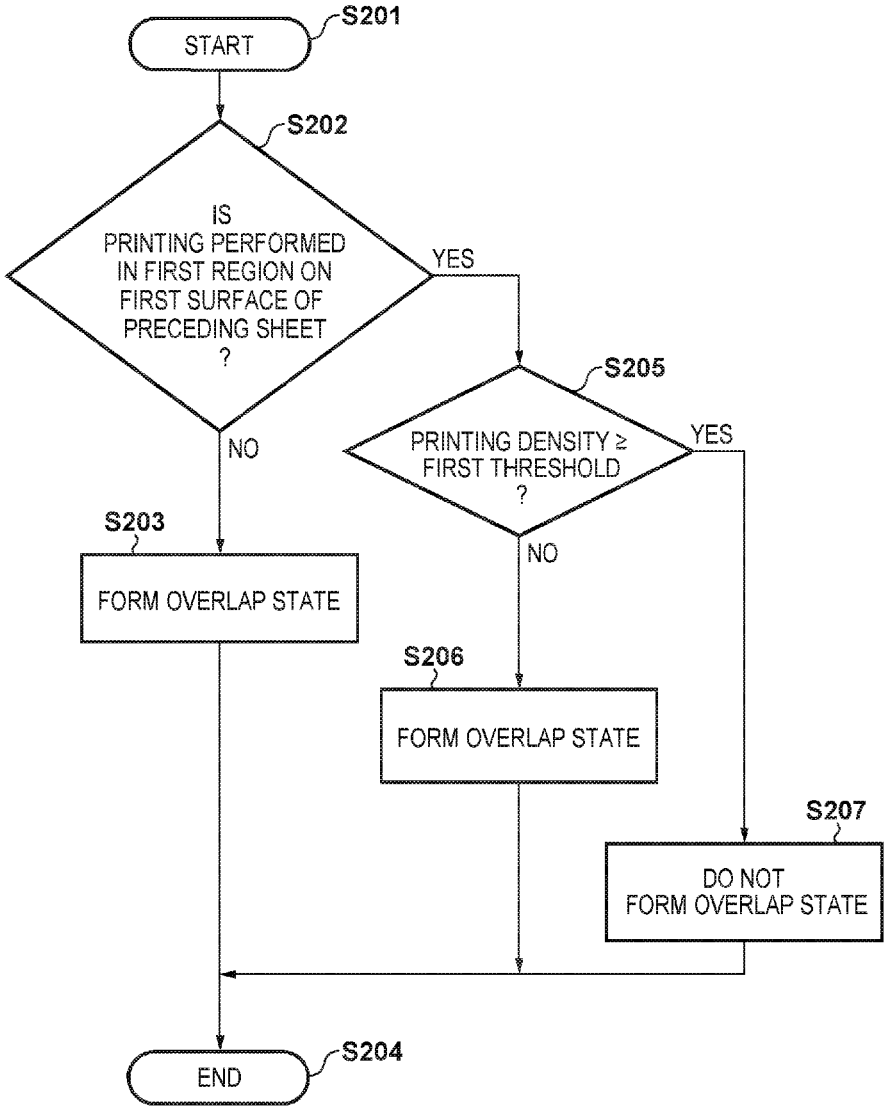
FIG. 10 is a flowchart illustrating the example of the process executed by the control unit of the printing apparatus in FIG. 1.

FIG. 10 is a flowchart illustrating an example of the process in step S121. The process starts in step S201. In step S202, it is determined whether an image is printed in the first region on the first surface (already printed surface) of the preceding sheet 1-A.

Figure 12B:
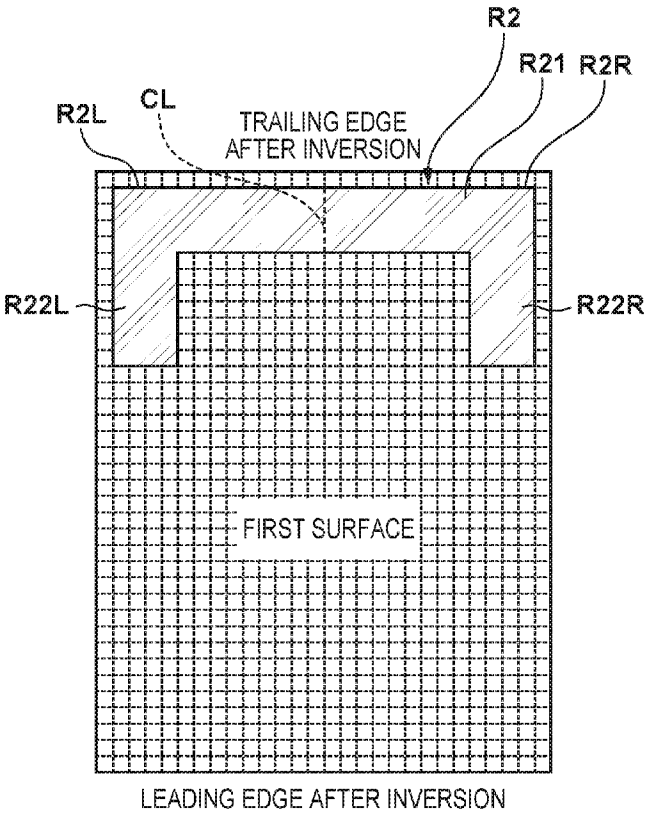
FIGS. 12A and 12B are views for explaining regions to which printing data is referred.
Figure 12A:
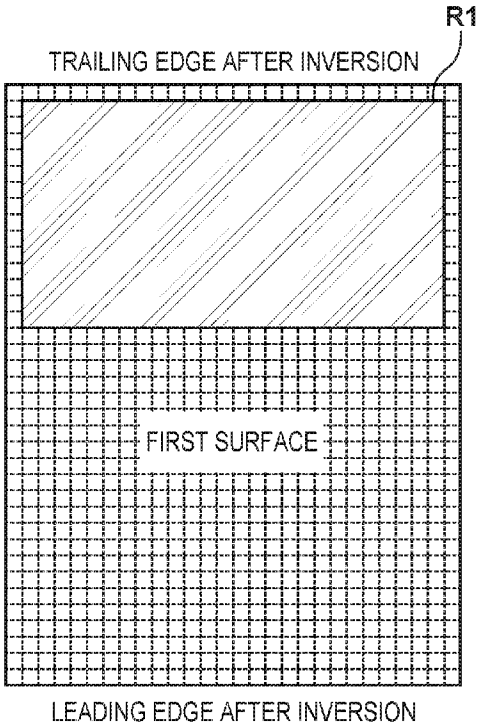

As described above, this determination process estimates the deformation in the sheet caused by printing the image on the first surface. Thus, a reference is made to the printing data on the first surface. Note that the smaller number of printing data to be referred to has an advantage in terms of processing speed. Therefore, in this embodiment, a reference range is limited to the first region of the first surface which is likely to influence an overlap with the succeeding sheet 1-B. In this embodiment, the first region is on the side of the trailing edge of the inverted preceding sheet 1-A. FIG. 12A is a plan view of the preceding sheet 1-A showing that example.

FIG. 12A shows the first surface as the already printed surface. Note that illustration of an image to be printed is omitted. A first region R1 to be referred to is set on the trailing edge side in the conveyance direction after an inversion. In this embodiment, the first region R1 is a band-shaped region extending in the left-right direction. By using the band-shaped first region R1, it is possible to refer to the range which is likely to influence the overlap with the succeeding sheet 1-B all around comparatively.

In an example of FIG. 12A, assuming printing with a border, the trailing edge, and the right and left edges in the conveyance direction are removed from the first region R1. For printing without the border, however, the first region R1 may have the trailing edge, and the right and left edges in the conveyance direction. Further, the range of the first region R1 may be changed depending on a condition that printing is performed with or without the border.

The first region R1 may include at least a range overlapping the leading edge of the succeeding sheet 1-B. This makes it possible to set, as a reference target, the range which is likely to influence the overlap with the succeeding sheet 1-B. A range where the trailing edge of the inverted preceding sheet 1-A and the leading edge of the succeeding sheet 1-B overlap each other can vary by these printing data or the like. The first region R1 may be a variable range that is set each time in accordance with the overlap range. Conversely, the first region R1 may be an invariable range (fixed range) that is set assuming the range which is likely to influence the overlap.

The deformation in the printing sheet is also influenced by the type of printing sheet. For example, thin paper may be deformed more easily than thick paper. The first region R1 may be the variable range which is changed in accordance with the type of printing sheet. For example, for a printing sheet comparatively less deformed like the thick paper, the first region R1 may be set narrower than the thin paper. The type of printing sheet can be specified based on information transmitted from the host computer 214.

Referring back to FIG. 10, if it is determined in step S202 that the image is printed in the first region R1, the process advances to step S205. If it is determined that no image is printed, the process advances to step S203. In step S203, it is determined that the first condition is satisfied (an overlap state is formed), thereby terminating the process. When this determination result is obtained, the process advances to step S122 of FIG. 8A.

In step S205, it is determined whether there is, in the first region R1, a pixel having a printing density equal to or larger than the first threshold. If there is such a pixel, the process advances to step S207. If there is no such pixel, the process advances to step S206. In step S206, it is determined that the first condition is satisfied (the overlap state is formed), thereby terminating the process. When this determination result is obtained, the process advances to step S122 of FIG. 8A. In step S207, it is determined that the first condition is not satisfied, thereby terminating the process. When this determination result is obtained, the process advances to step S134 of FIG. 9.

A pixel having a high printing density is highly likely to be deformed because of its large number of ink droplets. Therefore, in this embodiment, if there is the pixel having the printing density equal to or larger than the first threshold, the succeeding sheet 1-B is not conveyed to the position at which it overlaps the inverted preceding sheet 1-A, and successive overlapped conveyance is not performed.

In this embodiment, the printing density is determined for each pixel. However, a printing density in the unit of a plurality of adjacent pixels (for example, an average printing density) may be determined.

A possibility of a deformation relative to the printing density changes depending on the type of printing sheet. For example, the thin paper may be deformed more easily than the thick paper at a lower printing density. Therefore, the first threshold may be set based on the type of printing sheet.

The possibility of the deformation relative to the printing density also changes depending on a position. For example, the degree of deformation relative to the printing density may become higher in the peripheral portion than in the center-side portion of the printing sheet. Therefore, the first threshold may be set based on a position in the first region R1.

In this embodiment, the first condition only includes the condition related to the printing data. However, the first condition may also include another condition capable of estimating the deformation in the preceding sheet 1-A. The first condition may include, for example, a condition such as a temperature or a humidity.

<Determination of Second Condition>

The determination in step S123 will be described in detail. In this embodiment, it is determined in step S123 whether to, first of all, convey the succeeding sheet 1-B to the position at which it overlaps the inverted preceding sheet 1-A as much as possible, and then to perform successive overlapped conveyance. This contributes to improvement in the printing speed. Whether to execute successive overlapped conveyance need not be confirmed at the start of feeding the succeeding sheet 1-B. This is advantageous in that, for example, even if the marginal amount of the succeeding sheet 1-B is unknown at the start of feeding the succeeding sheet 1-B, successive overlapped conveyance can be performed at a point in time when the marginal amount is confirmed afterward.

Figure 11A:
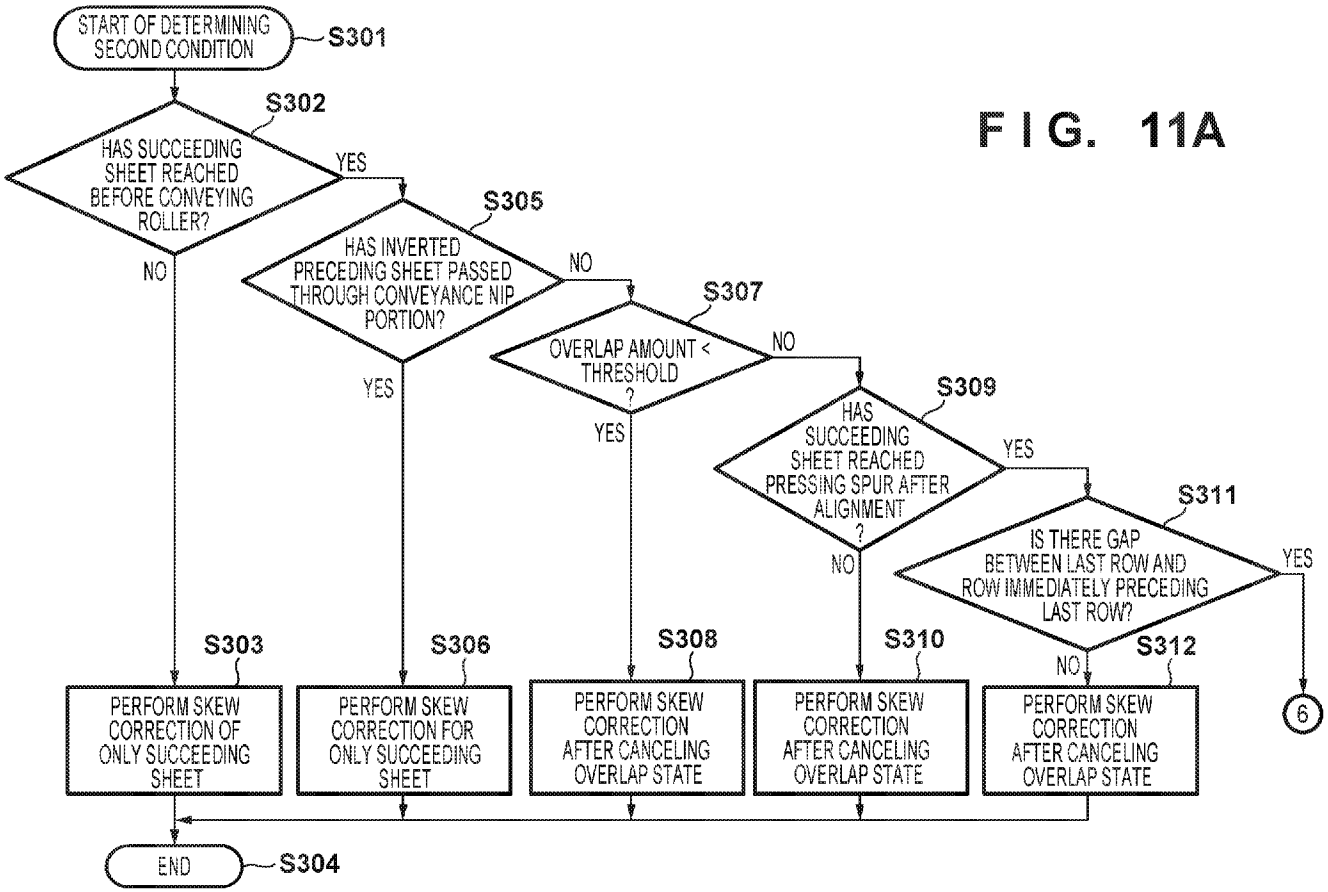
FIGS. 11A and 11B are flowcharts illustrating the example of the process executed by the control unit of the printing apparatus in FIG. 1.
Figure 11B:
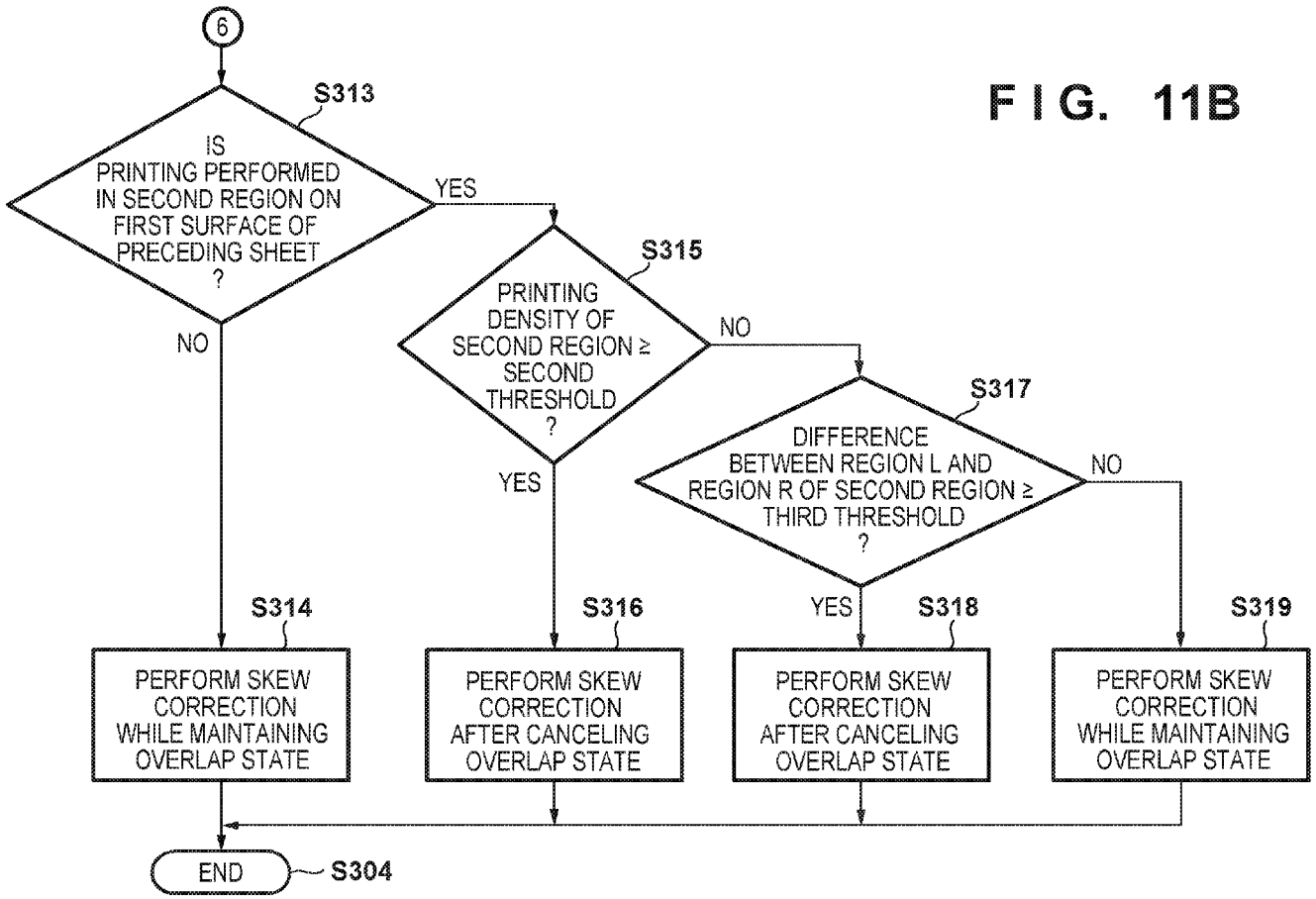

FIGS. 11A and 11B are flowcharts illustrating an example of the process in step S123. In step S301, the process starts. In step S302, it is determined whether the leading edge of the succeeding sheet 1-B has reached a predetermined position upstream of the conveyance nip portion (the position described with reference to the state ST12 of FIG. 4). If the leading edge has reached that position, the process advances to step S305. If the leading edge has not reached that position, it is uncertain whether the leading edge of the succeeding sheet 1-B abuts against the conveyance nip portion by a predetermined amount of conveyance. It is thus determined that the second condition is not satisfied, and a skew correcting operation for only the succeeding sheet is decided (step S303), thereby terminating the process. When this determination result is obtained, the process advances to step S127 FIG. 8B.

In step S305, it is determined whether the trailing edge of the inverted preceding sheet 1-A passes through the conveyance nip portion. If it is determined that the trailing edge does not pass through the conveyance nip portion, the process advances to step S307. If it is determined that the trailing edge passes through the conveyance nip portion, the inverted preceding sheet 1-A and the succeeding sheet 1-B do not overlap each other. It is thus determined that the second condition is not satisfied, and the skew correcting operation for only the succeeding sheet is decided (step S306), thereby terminating the process. When this determination result is obtained, the process advances to step S127 of FIG. 8B.

In step S307, it is determined whether the overlap amount of the trailing edge of the inverted preceding sheet 1-A and the leading edge of the succeeding sheet 1-B is smaller than a threshold. The position of the trailing edge of the inverted preceding sheet 1-A changes along with the printing operation of the preceding sheet 1-A. That is, the overlap amount decreases along with the printing operation of the inverted preceding sheet 1-A. If it is determined that the overlap amount is smaller than the threshold, the overlap state is canceled, and successive overlapped conveyance is not performed because successive overlapped conveyance may become unstable. It is thus determined that the second condition is not satisfied, and the skew correcting operation for only the succeeding sheet is decided (step S308), thereby terminating the process. When this determination result is obtained, the process advances to step S127 of FIG. 8B. If it is determined that the overlap amount is equal to or larger than the threshold, the process advances to step S309.

In step S309, it is determined whether the succeeding sheet 1-B reaches the pressing spur 12 when alignment of the succeeding sheet 1-B is performed. If it is determined the succeeding sheet 1-B reaches the pressing spur 12, the process advances to step S311. If it is determined that the succeeding sheet 1-B does not reach the pressing spur 12, the overlap state is canceled, and successive overlapped conveyance is not performed because successive overlapped conveyance may influence image formation of the succeeding sheet 1-B. It is thus determined that the second condition is not satisfied, and the skew correcting operation for only the succeeding sheet is decided (step S310), thereby terminating the process. When this determination result is obtained, the process advances to step S127 of FIG. 8B.

In step S311, it is determined whether there is a gap between the last row of the second surface of the inverted preceding sheet 1-A and the row immediately preceding the last row. If it is determined that there is the gap, the process advances to step S313. If it is determined that there is no gap, the overlap state is canceled, and successive overlapped conveyance is not performed. It is not necessarily the case that there is no possibility that the skew correcting operation of the succeeding sheet 1-B influences the image forming operation of the inverted preceding sheet 1-A. If there is no gap, that influence may be noticeable. Thus, the overlap state is canceled, and the skew correcting operation for only the succeeding sheet 1-B is performed. It is thus determined that the second condition is not satisfied, and the skew correcting operation for only the succeeding sheet is decided (step S312), thereby terminating the process. When this determination result is obtained, the process advances to step S127 of FIG. 8B.

Determinations in steps S313 to S317 are related to two-sided printing. The image has already been printed on the first surface of the inverted preceding sheet 1-A, and the printing image may influence conveyance of the succeeding sheet 1-B when successive overlapped conveyance is performed. For example, friction between the conveying roller 5 and the inverted preceding sheet 1-A does not become constant because of the printing image, and thus the succeeding sheet 1-B may be skewed. In steps S313 to S317, it is possible to prevent a conveyance failure of the succeeding sheet 1-B by determining a possibility of this problem and switching between whether or not to perform successive overlapped conveyance.

In step S313, it is determined whether an image is printed in the second region on the first surface (already printed surface) of the preceding sheet 1-A. As described above, this determination process estimates the conveyance failure of the succeeding sheet 1-B caused by printing the image on the first surface. Thus, a reference is made to the printing data on the first surface. Note that the smaller number of printing data to be referred to, the more the advantage in terms of processing speed. Therefore, in this embodiment, a reference range is limited to the second region of the first surface which is likely to influence conveyance of the succeeding sheet 1-B. In this embodiment, the second region is on the side of the trailing edge of the inverted preceding sheet 1-A. FIG. 12B is a plan view of the preceding sheet 1-A showing that example.

FIG. 12B shows the first surface as the already printed surface. Note that illustration of an image to be printed is omitted. A second region R2 to be referred to is set on the trailing edge side in the conveyance direction after an inversion. In this embodiment, the second region R2 is partially different from the first region R1 shown in FIG. 12A. The first region R1 aims at estimating the deformation in the preceding sheet 1-A, and the second region R2 aims at estimating the conveyance failure of the succeeding sheet 1-B. Thus, they are regions according to their respective purposes. Of course, the first region R1 and the second region R2 may have the same range. Alternatively, the first region R1 and the second region R2 may be different from each other entirely without having any overlapping range.

The second region R2 includes a band-shaped portion R21 extending in the left-right direction, and a pair of band-shaped portions R22L and R22R extending from two ends of the band-shaped portion R21 to the leading edge. In order to estimate a skew influence on the succeeding sheet 1-B, while a comparatively wide range is set in directions of the leading edge and trailing edge in the right and left edges of the first surface, a comparatively narrow range is set in the directions of the leading edge and trailing edge in the central portion.

As in the example of FIG. 12A, in an example of FIG. 12B, assuming printing with a border, the trailing edge, and the right and left edges in the conveyance direction are removed from the second region R2. For printing without the border, however, the second region R2 may have the trailing edge, and the right and left edges in the conveyance direction. Further, the range of the second region R2 may be changed depending on a condition that printing is performed with or without the border.

The second region R2 may fall within a range overlapping the leading edge of the succeeding sheet 1-B. This makes it possible to set, as a reference target, a range which is likely to influence conveyance of the succeeding sheet 1-B. The range where the trailing edge of the inverted preceding sheet 1-A and the leading edge of the succeeding sheet 1-B overlap each other can vary by these printing data or the like. The second region R2 may be a variable range that is set each time in accordance with the overlap range. Conversely, the second region R2 may be an invariable range (fixed range) that is set assuming the range which is likely to influence conveyance of the succeeding sheet 1-B.

The influence of the printing image of the preceding sheet 1-A on conveyance of the succeeding sheet 1-B also depends on the type of printing sheet. For example, depending on surface smoothness of the printing sheet, there may be a large difference in friction coefficient between a place where the image is printed and a place where no image is printed. The second region R2 may be the variable range which is changed in accordance with the type of printing sheet. For example, for a printing sheet having a small difference in friction coefficient between the place where the image is printed and the place where no image is printed, the second region R2 may be set narrower than the printing sheet having the large difference. The type of printing sheet can be specified based on information transmitted from the host computer 214.

Referring back to FIG. 11B, if it is determined in step S313 that the image is printed in the second region R2, the process advances to step S315. If it is determined that no image is printed, the process advances to step S314. In step S314, it is determined that the second condition is satisfied (skew correction while maintaining the overlap state), thereby terminating the process. When this determination result is obtained, the process advances to step S124 of FIG. 8B.

In step S315, it is determined whether there is, in the second region R2, a pixel having a printing density equal to or larger than the second threshold. If there is such a pixel, the process advances to step S316. If there is no such pixel, the process advances to step S317. In step S316, it is determined that the second condition is not satisfied, and the skew correcting operation for only the succeeding sheet is decided, thereby terminating the process. When this determination result is obtained, the process advances to step S127 of FIG. 8B.

For the pixel having the high printing density, surface roughness of the printing sheet may easily be influenced by the property of ink, and the surface roughness of the printing sheet may become uneven as a whole. This may skew the succeeding sheet 1-B. Therefore, in this embodiment, if there is the pixel having the printing density equal to or larger than the second threshold, successive overlapped conveyance is not performed.

In this embodiment, the printing density is determined for each pixel. However, the printing density in the unit of the plurality of adjacent pixels (for example, the average printing density) may be determined.

The influence of the surface roughness by the printing density changes depending on the type of printing sheet. For example, the influence differs between a sheet with high ink absorbency and a sheet with low ink absorbency. Therefore, the second threshold may be set based on the type of printing sheet.

The influence on conveyance of the succeeding sheet 1-B also changes depending on a position. For example, unevenness in the surface roughness caused by the printing density may be more likely to influence skew of the succeeding sheet 1-B in the peripheral portion than in the center-side portion of the printing sheet. Therefore, the second threshold may be set based on a position in the second region R2.

In step S317, it is determined whether a difference in printing density between right and left regions of the second region R2 is equal to or larger than the third threshold. Referring back to FIG. 12B, the second region R2 can virtually be divided into a region R2L and a region R2R by a center line CL on the right and left. Both of these regions R2L and R2R have the same L shape and area. If the friction coefficient largely differs between the region R2L and the region R2R, the succeeding sheet 1-B is highly likely to be skewed in successive overlapped conveyance.

In step S317, the printing density is compared between the region R2L and the region R2R. For example, a comparison method may determine whether a difference between the respective highest printing densities of the region R2L and the region R2R is equal to or larger than the third threshold. Alternatively, the comparison method may determine whether a difference between the respective average printing densities of the region R2L and the region R2R is equal to or larger than the third threshold. Alternatively, these may be combined.

Referring back to FIG. 11B, if it is determined in step S317 that the difference in printing density between the right and left regions of the second region R2 is equal to or larger than the third threshold, the process advances to step S318. If it is determined that the printing density difference is smaller than the third threshold, the process advances to step S319.

In step S318, it is determined that the second condition is not satisfied, the overlap state is canceled, and the skew correcting operation for only the succeeding sheet is decided, thereby terminating the process. When this determination result is obtained, the process advances to step S127 of FIG. 8B. In step S319, it is determined that the second condition is satisfied (skew correction while maintaining the overlap state), thereby terminating the process. When this determination result is obtained, the process advances to step S124 of FIG. 8B.

The process thus ends. In this embodiment, a plurality of conditions have been given as the second condition. However, all these conditions need not be given as the second condition. On the contrary, a condition other than the above-described conditions may be added to the second condition.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2015-177921, filed Sep. 9, 2015, which is hereby incorporated by reference herein in its entirety.

What is claimed is:

1. A printing apparatus comprising:

a feeding unit configured to feed a sheet;

a conveying unit configured to convey the sheet fed by the feeding unit;

a printing unit configured to print an image on the sheet conveyed by the conveying unit;

an inversion path for inverting the sheet having the image printed on a first surface by the printing unit and conveying the sheet to the conveying unit; and a conveyance control unit configured to control conveyance of a preceding sheet inverted by the inversion path and conveyance of a succeeding sheet fed by the feeding unit after the preceding sheet, wherein the conveyance control unit performs an overlap operation in which a leading portion of the succeeding sheet overlaps a trailing portion of the preceding sheet so that the leading portion contacts the trailing portion.

2. The apparatus according to claim 1, further comprising a determination unit configured to determine whether a predetermined condition is satisfied at a stage in which the succeeding sheet is positioned away from the preceding sheet, wherein, if the determination unit determines that the predetermined condition is satisfied, the conveyance control unit conveys the succeeding sheet to a position at which the leading portion of the succeeding sheet overlaps the trailing portion of the preceding sheet, and, if the determination unit determines that the predetermined condition is not satisfied, the conveying unit does not convey the succeeding sheet to the position at which the leading portion of the succeeding sheet overlaps the trailing portion of the preceding sheet, and does not perform the conveyance control.

3. The apparatus according to claim 2, wherein the predetermined condition includes at least a condition related to printing data on the first surface of the preceding sheet.

4. The apparatus according to claim 2, wherein the predetermined condition includes, in printing data on the first surface of the preceding sheet, at least a condition related to the printing data in a region on a side of the trailing portion of the preceding sheet.

5. The apparatus according to claim 2, wherein the printing apparatus comprises an inkjet printing apparatus, and the predetermined condition includes at least a condition related to a printing density of the first surface of the preceding sheet.

6. The apparatus according to claim 1, further comprising a determination unit configured to determine whether a predetermined condition is satisfied at a stage in which the succeeding sheet is at a position before the conveying unit, and in which the leading portion of the succeeding sheet overlaps the trailing portion of the preceding sheet, wherein, if the determination unit determines that the predetermined condition is satisfied, the conveyance control unit performs the conveyance control, and, if the determination unit determines that the predetermined condition is not satisfied, the conveyance control unit does not perform the conveyance control, and separates the preceding sheet and the succeeding sheet from each other.

7. The apparatus according to claim 6, wherein the predetermined condition includes at least a condition related to printing data on the first surface of the preceding sheet.

8. The apparatus according to claim 6, wherein the predetermined condition includes, in printing data on the first surface of the preceding sheet, at least a condition related to the printing data in a region on a side of the trailing portion of the preceding sheet.

9. The apparatus according to claim 6, wherein the printing apparatus comprises an inkjet printing apparatus, and the predetermined condition includes at least a condition related to a printing density of the first surface of the preceding sheet.

10. The apparatus according to claim 9, wherein the predetermined condition includes at least a condition related to a difference between a printing density on a right side of the first surface of the preceding sheet, and a printing density on a left side of the first surface of the preceding sheet.

11. The apparatus according to claim 1, further comprising:

a first determination unit configured to determine whether a first condition is satisfied; and a second determination unit configured to determine whether a second condition is satisfied if the first determination unit determines that the first condition is satisfied, wherein the conveyance control unit:

(i) conveys the succeeding sheet to a position at which the leading portion of the succeeding sheet overlaps the trailing portion of the preceding sheet if the first determination unit determines that the first condition is satisfied, (ii) does not convey the succeeding sheet to the position at which the leading portion of the succeeding sheet overlaps the trailing portion of the preceding sheet, and does not perform the conveyance control if the first determination unit determines that the first condition is not satisfied, (iii) performs the conveyance control if the second determination unit determines that the second condition is satisfied, and (iv) does not perform the conveyance control, and separates the preceding sheet and the succeeding sheet from each other if the second determination unit determines that the second condition is not satisfied.

12. The apparatus according to claim 11, wherein the first condition includes at least a condition related to printing data in a first region on the first surface of the preceding sheet, the second condition includes at least a condition related to printing data in a second region on the first surface of the preceding sheet, and the first region and the second region are at least partially different from each other.

13. The apparatus according to claim 11, wherein the first condition includes at least a condition related to printing data in a first region on the first surface of the preceding sheet, the second condition includes at least a condition related to printing data in a second region on the first surface, the first region is a band-shaped region extending in a left-right direction on a side of the trailing portion of the first surface of the preceding sheet, and the second region includes, on the side of the trailing portion of the first surface of the preceding sheet, a band-shaped portion extending in the left-right direction and a pair of band-shaped portions extending from two ends of the band-shaped portion toward a leading portion of the preceding sheet.

14. The apparatus according to claim 1, further comprising:

a pickup roller configured to convey a sheet stacked on a stack section to the feeding unit; and a discharging unit configured to convey the sheet conveyed from the printing unit to a discharge section, wherein the inversion path guides the sheet from the conveying unit to the feeding unit.

15. The apparatus according to claim 1, wherein the conveyance control unit starts conveying the succeeding sheet from a stack section on a condition that the trailing portion of the preceding sheet on the inversion path reaches a predetermined position.

16. The apparatus according to claim 1, wherein in the overlap operation, the leading portion of the succeeding sheet overlaps the trailing portion of the preceding sheet in a location between the feeding unit and the conveying unit.

17. The printing apparatus according to claim 1, wherein the leading portion includes a leading edge of the succeeding sheet, and the trailing portion includes a trailing edge of the preceding sheet.

18. The apparatus according to claim 1, further comprising a first determination unit configured to determine whether to perform the overlap operation based on printing data on the first surface of the preceding sheet.

19. The apparatus according to claim 18, wherein the first determination unit determines whether to perform the overlap operation based on the printing data in a first region on the first surface of the preceding sheet, and the first region is a region on a trailing side of the preceding sheet inverted by the inversion path.

20. The apparatus according to claim 19, wherein the first determination unit determines to perform the overlap operation if the printing data in the first region indicates non-printing.

21. The apparatus according to claim 19, wherein the first determination unit determines not to perform the overlap operation if a printing amount in a predetermined area in the first region is greater than a first threshold.

22. The apparatus according to claim 1, wherein the conveyance control unit performs an overlapped conveyance operation after performing the overlap operation, and, in the overlapped conveyance operation, the succeeding sheet is conveyed to a position facing the printing unit while the leading portion of the succeeding sheet is overlapping with the trailing portion of the preceding sheet.

23. The apparatus according to claim 22, wherein the conveying unit includes:

a conveying roller; and a pinch roller that is located at a position facing the conveying roller, and wherein, in the overlapped conveyance operation, the conveying roller and the pinch roller nip an overlap portion of the preceding sheet and the succeeding sheet and convey the preceding sheet and the succeeding sheet.

24. The apparatus according to claim 22, further comprising a second determination unit configured to determine whether to perform the overlapped conveyance operation based on printing data on the first surface of the preceding sheet.

25. The apparatus according to claim 24, wherein the second determination unit determines whether to perform the overlapped conveyance operation based on printing data in a second region on the first surface of the preceding sheet, and wherein the second region is a region of a trailing side of the preceding sheet inverted by the inversion path.

26. The apparatus according to claim 25, wherein the second determination unit determines to perform the overlapped conveyance operation if the printing data of the second region indicates non-printing.

27. The apparatus according to claim 25, wherein the second determination unit determines not to perform the overlapped conveyance operation and to convey the succeeding sheet to a position facing the printing unit to provide a predetermined interval between the trailing portion of the preceding sheet and the leading portion of the succeeding sheet if a printing amount in a predetermined area in the second region is greater than a second threshold.

28. The apparatus according to claim 25, wherein the second region includes a region of a left trailing side and a region of a right trailing side of the preceding sheet inverted by the inversion path, and wherein the second determination unit determines not to perform the overlapped conveyance operation and to convey the succeeding sheet to a position facing the printing unit with a predetermined interval between the trailing portion of the preceding sheet and the leading portion of the succeeding sheet if a difference between a printing amount in a predetermined area in the region of the left trailing side and a printing amount in a predetermined area in the region of the right trailing side is greater than a third threshold.

29. A control method of a printing apparatus including a feeding unit configured to feed a sheet, a conveying unit configured to convey the sheet fed by the feeding unit, a printing unit configured to print an image on the sheet conveyed by the conveying unit, and an inversion path for inverting the sheet having the image printed on a first surface by the printing unit and to convey the sheet to the conveying unit, the method comprising:

inverting, by the inversion path, the sheet having the image printed on the first surface by the printing unit and conveying the sheet to the conveying unit; and controlling conveyance of an inverted preceding sheet and conveyance of a succeeding sheet fed by the feeding unit after the preceding sheet, wherein the controlling includes an overlap operation in which a leading portion of the succeeding sheet overlaps a trailing portion of a preceding sheet so that the leading portion of the succeeding sheet contacts the trailing portion of the preceding sheet if a predetermined condition is satisfied.

30. A non-transitory computer-readable storage medium which stores a program controlling a printing apparatus, the printing apparatus including a feeding unit configured to feed a sheet, a conveying unit configured to convey the sheet fed by the feeding unit, and a printing unit configured to print an image on the sheet conveyed by the conveying unit, and an inversion path for inverting the sheet having the image printed on a first surface by the printing unit and convey the sheet to the conveying unit, the program causing the printing apparatus to execute:

inverting, by the inversion path, the sheet having the image printed on the first surface by the printing unit and conveying the sheet to the conveying unit, and controlling conveyance of an inverted preceding sheet and conveyance of a succeeding sheet fed by the feeding unit after the preceding sheet, wherein the controlling includes an overlap operation in which a leading portion of the succeeding sheet overlaps a trailing portion of a preceding sheet so that the leading portion of the succeeding sheet contacts the trailing portion of the preceding sheet if a predetermined condition is satisfied.

* * * * *